US008007311B2

(12) United States Patent
Hogue et al.

(10) Patent No.: US 8,007,311 B2
(45) Date of Patent: Aug. 30, 2011

(54) ELECTRICAL CONNECTOR

(75) Inventors: Jason Allan Hogue, Wyee (AU); Michael Sielaff, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/531,206

(22) PCT Filed: Feb. 29, 2008

(86) PCT No.: PCT/AU2008/000281
§ 371 (c)(1),
(2), (4) Date: Jan. 5, 2010

(87) PCT Pub. No.: WO2008/109923
PCT Pub. Date: Sep. 18, 2008

(65) Prior Publication Data

US 2010/0105250 A1 Apr. 29, 2010

(30) Foreign Application Priority Data

Mar. 14, 2007 (AU) ..... 2007201106

(51) Int. Cl.
*H01R 24/00* (2006.01)

(52) U.S. Cl. ..... 439/404; 439/676; 439/941

(58) Field of Classification Search ..... 439/404, 439/676, 941, 405
See application file for complete search history.

(56) References Cited

U.S. PATENT DOCUMENTS 4,766,402 A 8/1988 Crane
4,831,497 A 5/1989 Webster et al.
5,110,304 A 5/1992 Kjeldahl
5,186,647 A 2/1993 Denkmann et al.
5,299,956 A 4/1994 Brownell et al.
5,700,167 A 12/1997 Pharney et al.
5,762,518 A 6/1998 Tanigawa et al.
5,864,089 A 1/1999 Rainal
5,940,959 A 8/1999 Caveney et al.
5,957,720 A 9/1999 Boudin
5,967,828 A 10/1999 Geurts et al.

(Continued)

FOREIGN PATENT DOCUMENTS

AU 708833 2/1998

(Continued)

OTHER PUBLICATIONS

Prosecution History of U.S. Appl. No. 12/531,218 (Office Action Nov. 10, 2010).

(Continued)

*Primary Examiner* — Gary F. Paumen
(74) *Attorney, Agent, or Firm* — Merchant & Gould P.C.

(57) ABSTRACT

An electrical connector for transmitting data signals between the insulated conductors of a first data cable and corresponding insulated conductors of a second data cable, including a socket shaped to at least partially receive a plug of said first data cable; a plurality of insulation displacement contact slots shaped to receive end sections of the conductors of the second data cable; and a plurality of electrically conductive contacts including resiliently compressible spring finger contacts extending into the socket for electrical connection with corresponding conductors of the first cable; and insulation displacement contacts seated in corresponding insulation displacement contact slots for effecting electrical connection with corresponding conductors of the second data cable, wherein the insulation displacement contact slots are arranged so that adjacent pairs of insulation displacement contacts open in different directions.

6 Claims, 29 Drawing Sheets

U.S. PATENT DOCUMENTS

| | | | | |
|---|---|---|---|---|
| 5,997,358 | A | 12/1999 | Adriaenssens et al. | |
| 6,017,247 | A | 1/2000 | Gwiazdowski | |
| 6,042,427 | A | 3/2000 | Adriaenssens et al. | |
| 6,107,578 | A | 8/2000 | Hashim | |
| 6,120,330 | A | 9/2000 | Gwiazdowski | |
| 6,139,371 | A | 10/2000 | Troutman et al. | |
| 6,168,474 | B1 | 1/2001 | German et al. | |
| 6,231,397 | B1 | 5/2001 | de la Borbolla et al. | |
| 6,284,980 | B1 | 9/2001 | Filus et al. | |
| 6,319,069 | B1 | 11/2001 | Gwiazdowski | |
| 6,334,792 | B1 | 1/2002 | Schmidt et al. | |
| 6,371,793 | B1 | 4/2002 | Doorhy et al. | |
| 6,375,490 | B1 | 4/2002 | Yao | |
| 6,428,362 | B1 | 8/2002 | Phommachanh | |
| 6,441,318 | B1 | 8/2002 | Kiersh et al. | |
| 6,443,777 | B1 | 9/2002 | McCurdy et al. | |
| 6,464,541 | B1 | 10/2002 | Hashim et al. | |
| 6,520,806 | B2 | 2/2003 | Phommachanh | |
| 6,520,808 | B2 | 2/2003 | Forbes et al. | |
| 6,533,618 | B1 | 3/2003 | Aekins | |
| 6,602,089 | B2 | 8/2003 | Abe et al. | |
| RE38,519 | E | 5/2004 | Doorhy et al. | |
| 6,736,681 | B2 | 5/2004 | Arnett | |
| 6,743,983 | B2 | 6/2004 | Wickhorst et al. | |
| 6,799,989 | B2 | 10/2004 | Doorhy et al. | |
| 6,830,488 | B2 | 12/2004 | Bush et al. | |
| 6,840,816 | B2 | 1/2005 | Aekins | |
| 6,866,548 | B2 | 3/2005 | Hashim | |
| 6,869,317 | B2 | 3/2005 | Weatherley | |
| 6,923,673 | B2 | 8/2005 | Doorhy et al. | |
| 7,052,328 | B2 | 5/2006 | Ciezak et al. | |
| 7,097,513 | B2 | 8/2006 | Bryan | |
| 7,186,149 | B2 | 3/2007 | Hashim | |
| 7,220,149 | B2 | 5/2007 | Pharney | |
| 7,249,979 | B2 | 7/2007 | Gerber et al. | |
| 7,255,590 | B2 | 8/2007 | Schremmer et al. | |
| 7,265,300 | B2 | 9/2007 | Adriaenssens et al. | |
| 7,381,098 | B2 | 6/2008 | Hammond, Jr. et al. | |
| 7,402,085 | B2 | 7/2008 | Hammond, Jr. et al. | |
| 7,413,464 | B1 | 8/2008 | Chen | |
| 7,517,255 | B2 | 4/2009 | Hetzer et al. | |
| 7,651,380 | B2 | 1/2010 | Below et al. | |
| 7,695,307 | B2 * | 4/2010 | Mossner et al. | 439/404 |
| 7,726,018 | B2 * | 6/2010 | Caveney et al. | 29/876 |
| 7,787,615 | B2 | 8/2010 | Hammond, Jr. et al. | |
| 2001/0018288 | A1 | 8/2001 | Nicholls | |
| 2003/0119372 | A1 | 6/2003 | Aekins | |
| 2004/0055777 | A1 | 3/2004 | Wickhorst et al. | |
| 2004/0055779 | A1 | 3/2004 | Wickhorst et al. | |
| 2004/0067693 | A1 | 4/2004 | Arnett | |
| 2004/0077222 | A1 | 4/2004 | AbuGazaleh et al. | |
| 2004/0082227 | A1 | 4/2004 | Hashim | |
| 2004/0184247 | A1 | 9/2004 | Adriaenssens et al. | |
| 2004/0216913 | A1 | 11/2004 | Wickhorst et al. | |
| 2005/0092514 | A1 | 5/2005 | Kenny et al. | |
| 2005/0092515 | A1 | 5/2005 | Kenny et al. | |
| 2005/0106946 | A1 | 5/2005 | Doorhy et al. | |
| 2005/0167146 | A1 | 8/2005 | Wickhorst et al. | |
| 2005/0167148 | A1 | 8/2005 | Wickhorst et al. | |
| 2005/0186838 | A1 | 8/2005 | Debenedictis et al. | |
| 2005/0186844 | A1 | 8/2005 | Hammond, Jr. et al. | |
| 2005/0221677 | A1 | 10/2005 | Hammond, Jr. et al. | |
| 2005/0221678 | A1 | 10/2005 | Hammond, Jr. | |
| 2005/0250372 | A1 | 11/2005 | Doorhy et al. | |
| 2005/0253662 | A1 | 11/2005 | Seefried | |
| 2005/0254223 | A1 | 11/2005 | Hashim et al. | |
| 2006/0014410 | A1 | 1/2006 | Caveney | |
| 2006/0183359 | A1 | 8/2006 | Gerber et al. | |
| 2007/0238367 | A1 | 10/2007 | Hammond, Jr. et al. | |
| 2010/0087097 | A1 | 4/2010 | Hogue et al. | |
| 2010/0151740 | A1 | 6/2010 | Hogue et al. | |
| 2010/0167577 | A1 | 7/2010 | Hogue et al. | |
| 2010/0167578 | A1 | 7/2010 | Hogue et al. | |
| 2010/0197160 | A1 | 8/2010 | Hogue et al. | |
| 2010/0203755 | A1 | 8/2010 | Hogue et al. | |
| 2010/0210132 | A1 | 8/2010 | Hogue et al. | |

FOREIGN PATENT DOCUMENTS

| | | | |
|---|---|---|---|
| AU | 739518 | | 9/1999 |
| AU | 739904 | | 10/1999 |
| AU | 756997 | | 1/2000 |
| AU | 4468199 | | 3/2000 |
| DE | 203 19 849 | | 6/2005 |
| EP | 0 898 340 | A1 | 2/1999 |
| EP | 0 901 201 | A1 | 3/1999 |
| FR | 2 760 136 | | 8/1998 |
| GB | 2 271 678 | A | 4/1994 |
| GB | 2 314 466 | A | 12/1997 |
| WO | WO 00/62372 | | 10/2000 |
| WO | WO 0062372 | | 10/2000 |
| WO | WO 02/17442 | A2 | 2/2002 |

OTHER PUBLICATIONS

Prosecution History of U.S. Appl. No. 12/531,225 (Office Action Nov. 23, 2010).

Prosecution History of U.S. Appl. No. 12/531,258 (Office Action Nov. 3, 2010).

Prosecution History of U.S. Appl. No. 12/531,218 (Office Action Apr. 28, 2011).

Prosecution History of U.S. Appl. No. 12/531,238 (Office Action Apr. 26, 2011).

* cited by examiner

ELECTRICAL CONNECTOR

CROSS-REFERENCE TO RELATED APPLICATIONS

This application is a National Stage Application of PCT/AU2008/000281, filed 29 Feb. 2008, which claims benefit of Serial No. 2007201106, filed 14 Mar. 2007 in Australia and which applications are incorporated herein by reference. To the extent appropriate, a claim of priority is made to each of the above disclosed applications.

TECHNICAL FIELD OF THE INVENTION

The present invention relates to an electrical connector.

BACKGROUND OF THE INVENTION

The international community has agreed to a set of architectural standards for intermatability of electrical connectors for the telecommunications industry. The connectors that are most commonly used are modular plugs and jacks that facilitate interconnection of electronic data cables, for example.

A plug typically includes a generally rectangular housing having an end section shaped for at least partial insertion into a socket of a corresponding jack. The plug includes a plurality of contact elements electrically connected to the insulated conductors of an electronic data cable. The contact elements extend through the housing so that free ends thereof are arranged in parallel on an outer peripheral surface of the end section of the plug. The other end of the cable may be connected to a telephone handset, for example.

A jack may be mounted to a wall panel, for example, and includes a socket shaped to at least partially receive an end section of a modular plug, and a plurality of insulation displacement contact slots for receiving respective ones of insulated conductors of an electronic data cable. The jack also includes a plurality of contact elements for electrically connecting conductors of the plug to corresponding conductors of the electronic data cable. First of the contacts are arranged in parallel as spring finger contacts in the socket. The spring finger contacts resiliently bearing against corresponding contact elements of the modular plug when it is inserted in the socket in the above-described manner. Second ends of the contact elements include insulation displacement contacts that open into respective ones of the insulation displacement contact slots. Each insulation displacement contact is formed from contact element which is bifurcated so as to define two opposed contact portions separated by a slot into which an insulated conductor may be pressed so that edges of the contact portions engage and displace the insulation such that the contact portions resiliently engage, and make electrical connection with, the conductor. The two opposed contact portions of the insulation displacement contacts are laid open in corresponding insulation displacement contact slots. As such, an end portion of an insulated conductor can be electrically connected to an insulation displacement contact by pressing the end portion of the conductor into an insulation displacement contact slot.

The above-mentioned electronic data cables typically consist of a number of twisted pairs of insulated copper conductors held together in a common insulating jacket. Each twisted pair of conductors is used to carry a single stream of information. The two conductors are twisted together, at a certain twist rate, so that any external electromagnetic fields tend to influence the two conductors equally, thus a twisted pair is able to reduce crosstalk caused by electromagnetic coupling.

The arrangement of insulated conductors in twisted pairs may be useful in reducing the effects of crosstalk in data cables. However, at high data transmission rates, the wire paths within the connector jacks become antennae that both broadcast and receive electromagnetic radiation. Signal coupling, ie crosstalk, between different pairs of wire paths in the jack is a source of interference that degrades the ability to process incoming signals.

The wire paths of the jack are arranged in pairs, each carrying data signals of corresponding twisted pairs of the data cable. Cross talk can be induced between adjacent pairs where they are arranged closely together. The cross talk is primarily due to capacitive and inductive couplings between adjacent conductors. Since the extent of the cross talk is a function of the frequency of the signal on a pair, the magnitude of the cross talk is logarithmically increased as the frequency increases. For reasons of economy, convenience and standardisation, it is desirable to extend the utility of the connector plugs and jacks by using them at higher data rates. The higher the data rate, the greater difficulty of the problem. These problems are compounded because of international standards that assign the wire pairs to specified terminals.

Terminal wiring assignments for modular plugs and jacks are specified in ANSI/EIA/TIA-568-1991 which is the Commercial Building Telecommunications Wiring Standard. This Standard associates individual wire-pairs with specific terminals for an 8-position, telecommunications outlet (T568B). The pair assignment leads to difficulties when high frequency signals are present on the wire pairs. For example, the wire pair 3 straddles wire pair 1, as viewed looking into the socket of the jack. Where the electrical paths of the jack are arranged in parallel and are in the same approximate plane, there is electrical crosstalk between pairs 1 and 3. Many electrical connectors that receive modular plugs are configured that way, and although the amount of crosstalk between pairs 1 and 3 is insignificant in the audio frequency band, it is unacceptably high at frequencies above 1 MHz. Still, it is desirable to use modular plugs and jacks of this type at these higher frequencies because of connection convenience and cost.

U.S. Pat. No. 5,299,956 teaches cancellation of the cross talk arising in the jack using capacitance formed on the circuit board which is connected to the jack. U.S. Pat. No. 5,186,647 teaches of the reduction of cross talk in an electrical connector by crossing over the paths of certain contact elements in the electrical connector. While these approaches to reducing cross talk may be useful, they may not be sufficient to satisfy the ANSI/TIA/EIA-568-B.2-1 standard for Gigabit Ethernet (the so-called "Category 6" cabling standard). This standard defines much more stringent conditions for crosstalk along the cable than that defined in ANSI/TIA/EIA-568-A for Category 5 cable. The high-frequency operation demanded from the Category 6 standard also produces problems for the connectors and jacks used to connect any two Category 6 cables.

Insulation displacement contacts are often used in electrical connectors in order to simplify the connection of cables to the connector. Insulation displacement contacts are often mounted in parallel, in an effort to simplify the insertion of the insulated conductors into the connector. In high-speed and high-frequency electronic applications, such as data communication, the positioning of these insulation displacement contacts becomes important as they can introduce unwanted capacitive coupling. This capacitive coupling can increase the crosstalk and reduce signal quality.

It is generally desirable to overcome or ameliorate one or more of the above mentioned difficulties, or at least provide a useful alternative.

SUMMARY OF THE INVENTION

In accordance with one aspect of the present invention, there is provided an electrical connector for transmitting data signals between the insulated conductors of a first data cable and corresponding insulated conductors of a second data cable, including:

(a) a socket shaped to at least partially receive a plug of said first data cable;

(b) a plurality of insulation displacement contact slots shaped to receive end sections of the conductors of the second data cable; and (c) a plurality of electrically conductive contacts including resiliently compressible spring finger contacts extending into the socket for electrical connection with corresponding conductors of the first cable; and insulation displacement contacts seated in corresponding insulation displacement contact slots for effecting electrical connection with corresponding conductors of the second data cable;

wherein the insulation displacement contact slots are arranged so that adjacent pairs of insulation displacement contacts open in different directions.

Preferably, the insulation displacement contact slots are arranged so that pairs of insulation displacement contacts open in common directions.

Preferably, the insulation displacement contact slots are arranged so that the corresponding insulation displacement contacts engage end sections of the conductors of the second data cable at an angle of forty five degrees to the direction of extent of said end sections.

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
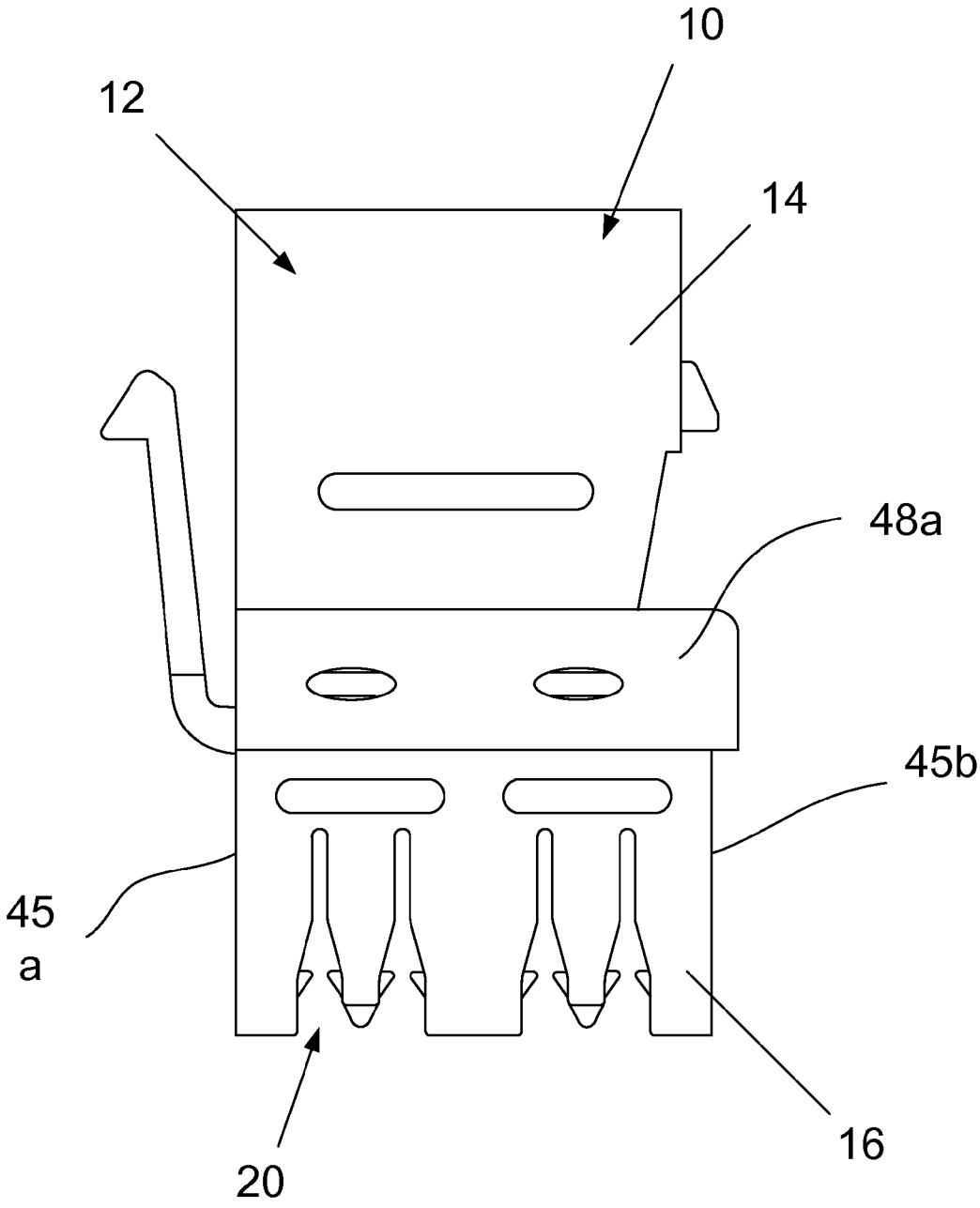
FIG. 1 is a diagrammatic illustration of a side view of a connector.
Figure 2:
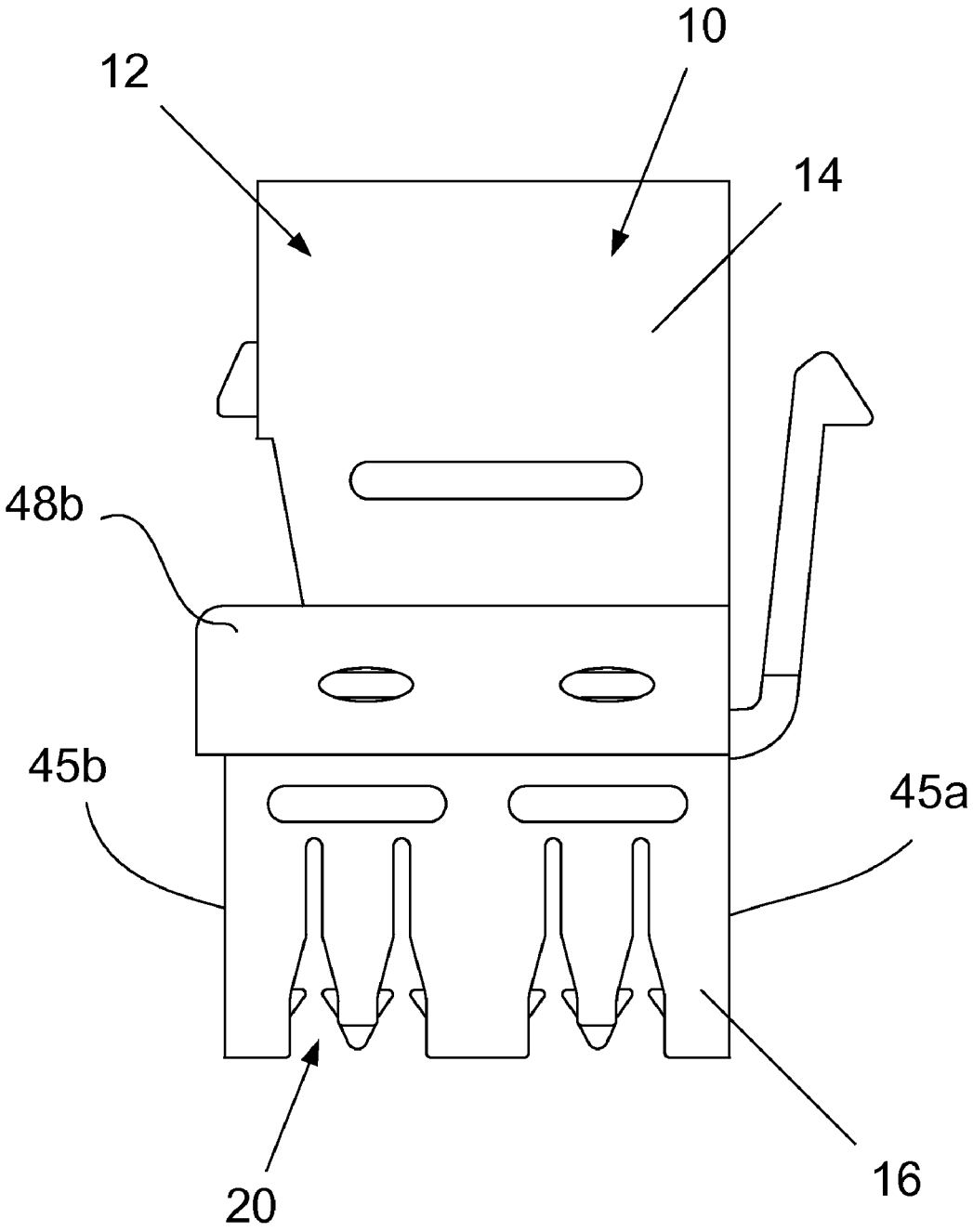
FIG. 2 is a diagrammatic illustration of another side view of the connector shown in FIG. 1.
Figure 3:
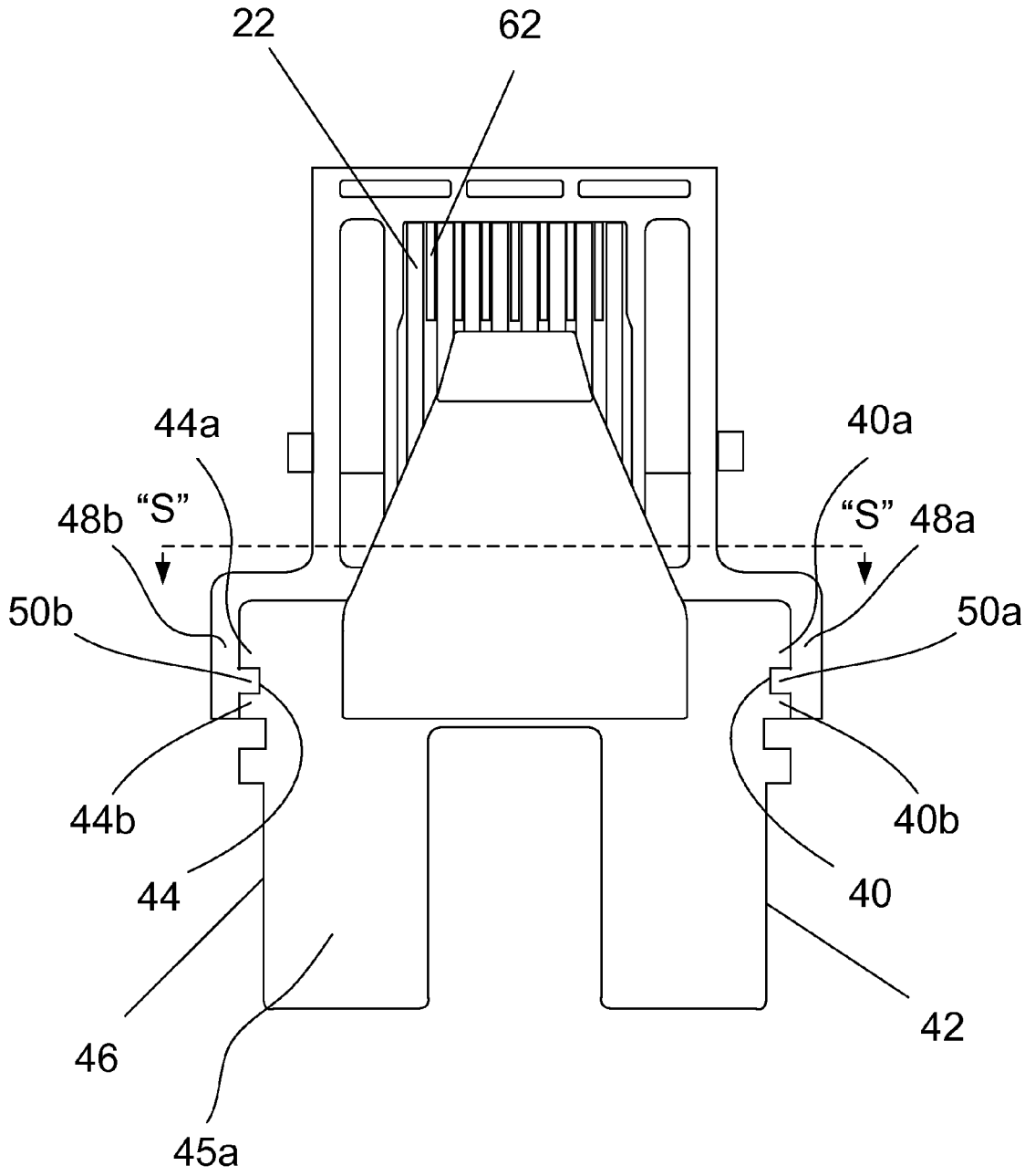
FIG. 3 is a diagrammatic illustration of a top view the connector shown in FIG. 1.
Figure 4:
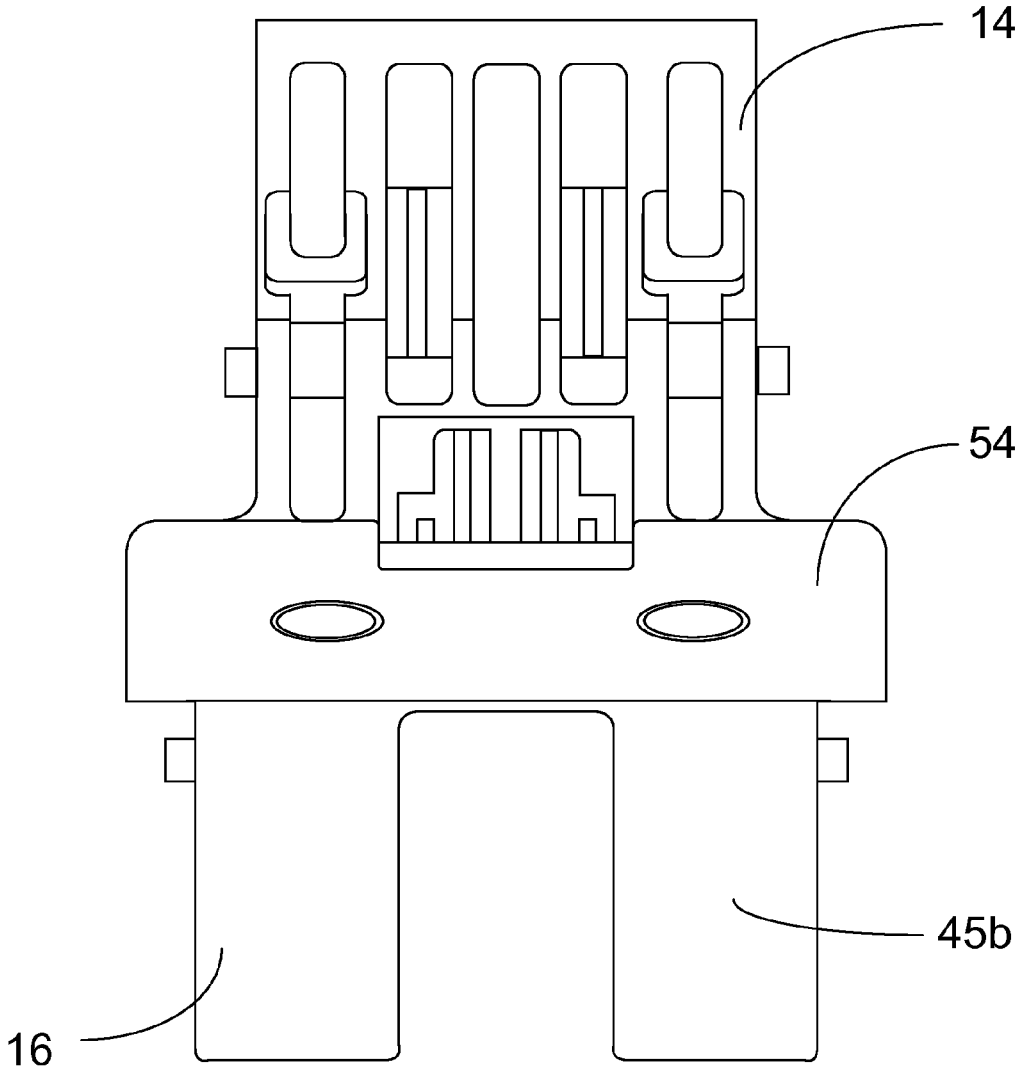
FIG. 4 is a diagrammatic illustration of a bottom view of the connector shown in FIG. 1.
Figure 5:
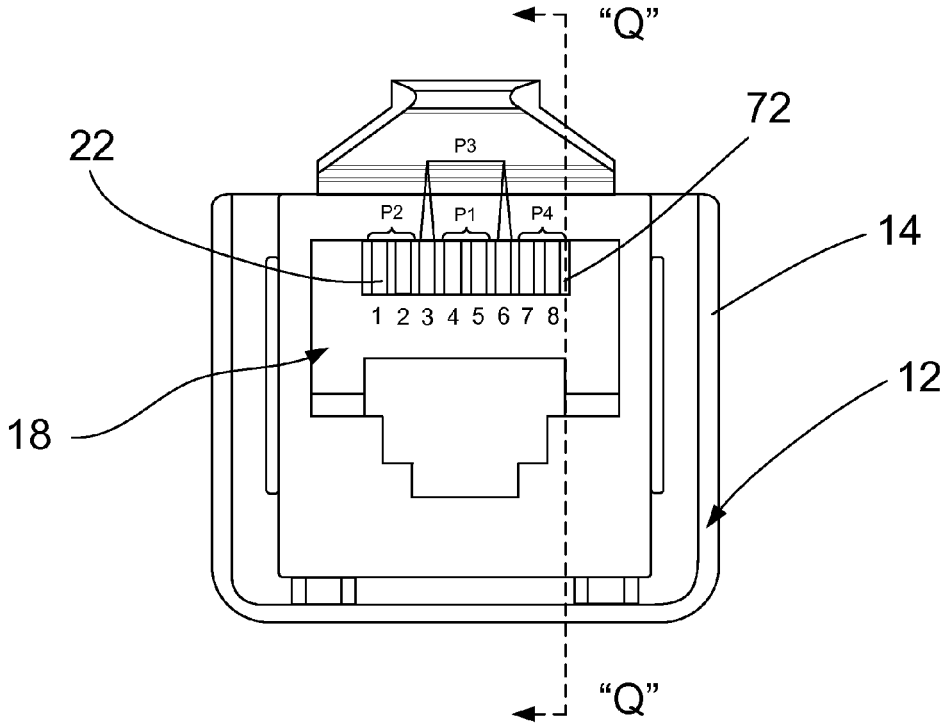
FIG. 5 is a diagrammatic illustration of a front view of the connector jack shown in FIG. 1.
Figure 6:
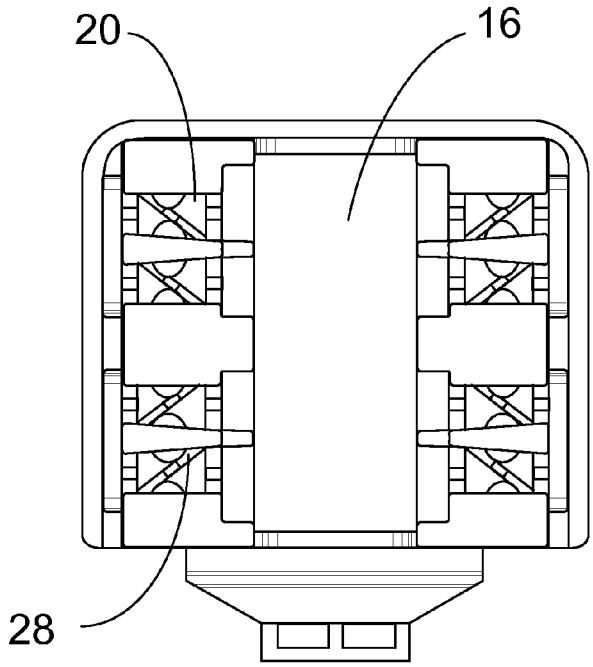
FIG. 6 is a diagrammatic illustration of a back view of the connector jack shown in FIG. 1.
Figure 7:
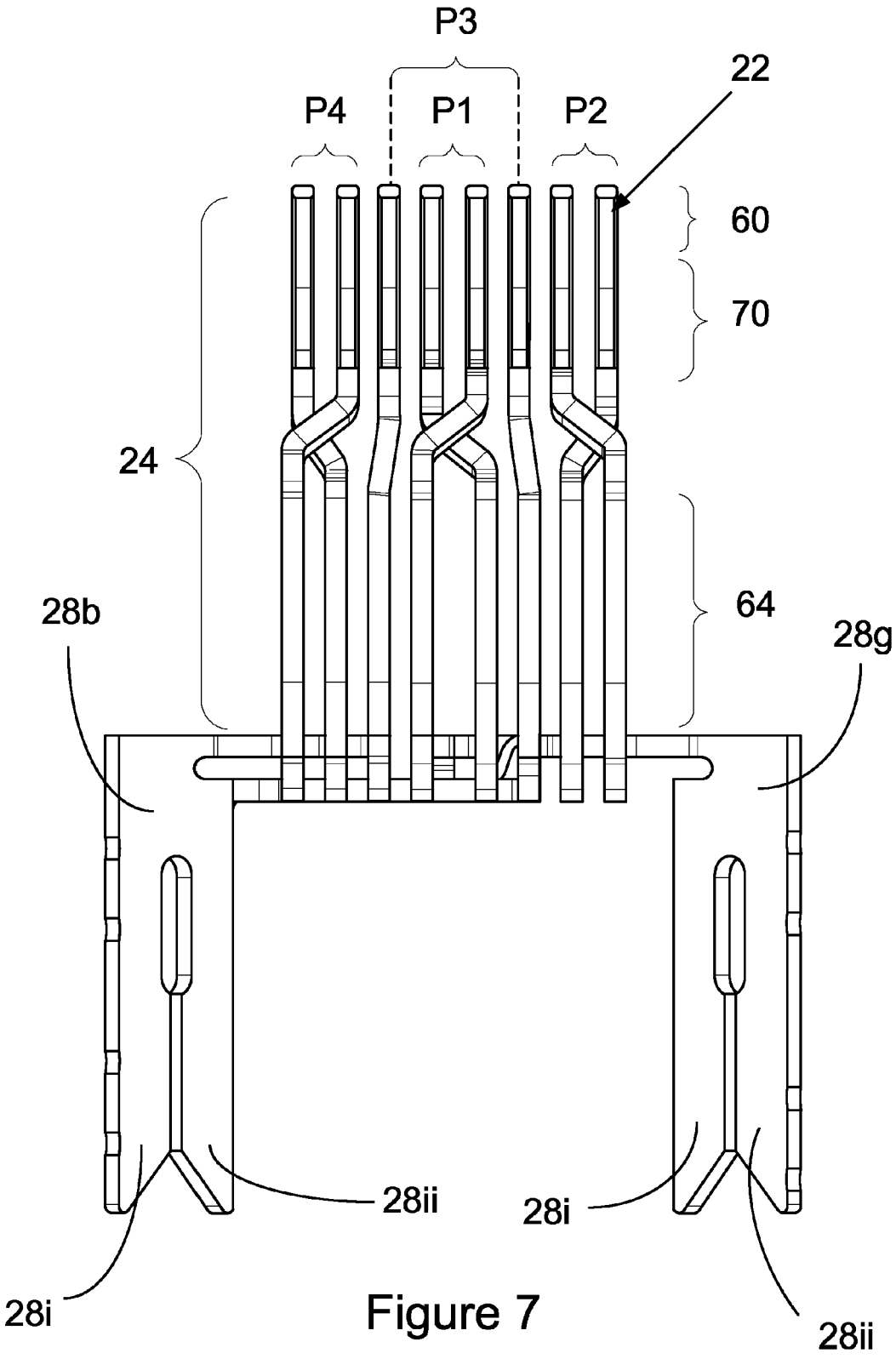
FIG. 7 is a diagrammatic illustration of a top view of the electrically conductive contact elements of the connector shown in FIG. 1.

The electrical connector 10, also referred to as the Jack 10, shown in FIGS. 1 to 6 includes a housing 12 formed in front 14 and back 16 interlocking parts. The front part 14 of the housing 12 includes a socket 18 that is shaped to at least partially receive a male section of a modular plug (not shown) that terminates the insulated conductors of an electric data cable. The back part 16 of the housing 12 includes insulation displacement contact slots 20 that are each shaped to receive an end section of an insulated conductor of an electronic data cable (not shown).

The electrical connector 10 also includes eight electrically conductive contact elements 22, as shown in FIGS. 7 to 11, that each extend between the socket 18 and corresponding insulation displacement contact slots 20. The contact elements 22 electrically connect conductors of a first electronic data cable connected to the socket 18 to corresponding conductors of another electronic data cable coupled to respective ones of the insulation displacement contact slots 20.

The first end of each contact 22 is a resiliently compressible spring finger contact 24 joined to a fixed section 34 by an elbow 25. The spring finger contacts 24 are arranged for electrical connection to corresponding contact of a mating modular plug (not shown) seated in the socket 18. The spring finger contacts 24 resiliently bear against corresponding contact elements of a modular plug when the plug is inserted into the socket 18. Second ends 26 of the contact elements 22 include insulation displacement contacts 28 that open into respective ones of the insulation displacement contact slots 20. Each insulation displacement contact 28 is bifurcated so as to define two opposed contact portions 28*i*, 28*ii* separated by a slot into which an insulated conductor may be pressed so that edges of the contact portions 28*i*, 28*ii* engage and displace the insulation. In doing so, the contact portions 28*i*, 28*ii* resiliently engage, and make electrical connection with, the conductor. The two opposed contact portions 28*i*, 28*ii* of the insulation displacement contacts 28 are laid open in corresponding insulation displacement contact slots 20. As such, an end portion of an insulated conductor can be electrically connected to an insulation displacement contact 28 by pressing the end portion of the conductor into an insulation displacement contact slot 20.

Figure 14:
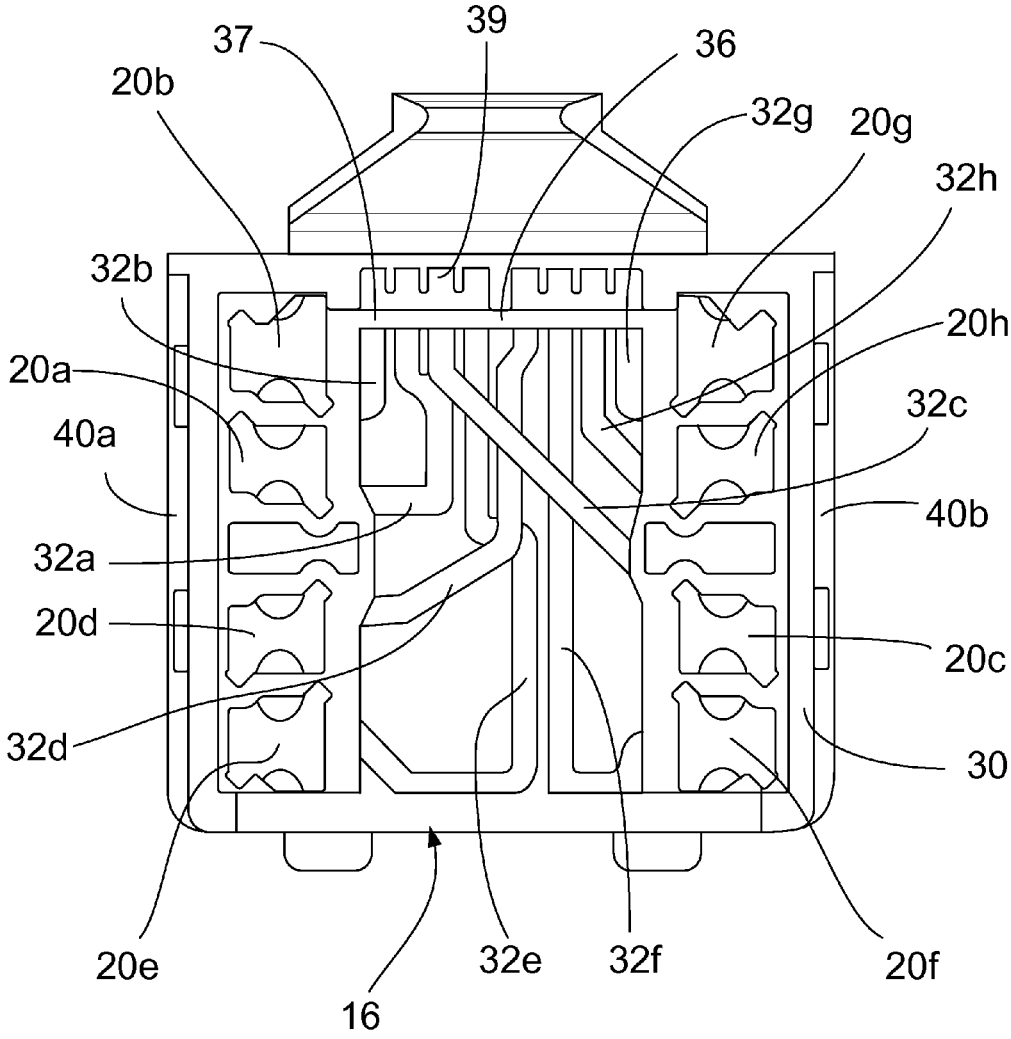
FIG. 14 is a diagrammatic illustration of a front view of the back part of the housing of the connector shown in FIG. 1.

As particularly shown in FIG. 14, a generally planar front side 30 of the back part 16 of the housing 12 includes eight channels 32. Each channel 32 is shaped to receive, and seat therein, a fixed section 34 of a contact 22 in the manner shown in FIG. 15. The channels 32 follow predetermined paths designed induce and restrict capacitive coupling between adjacent pairs of contacts 22. A description of the arrangement of the channels 32 is set out in further detail below.

The channels 32 are predominantly 0.5 mm in depth (depth being defined as the distance recessed in a direction perpendicular to the normal of the plane). However, at any point where two tracks cross one another, the depth of the channel is increased to 1.5 mm. The width of channels 32 is 0.6 mm. The corresponding fixed sections 34 of the contacts 22 are 0.5 mm wide and 0.5 mm deep. The fixed sections 34 of the contacts 22 thereby snugly fit into their corresponding channels 32. Frictional engagement between the channels 32 and the contacts 22 inhibits lateral movement of the contacts 22.

Figure 17:
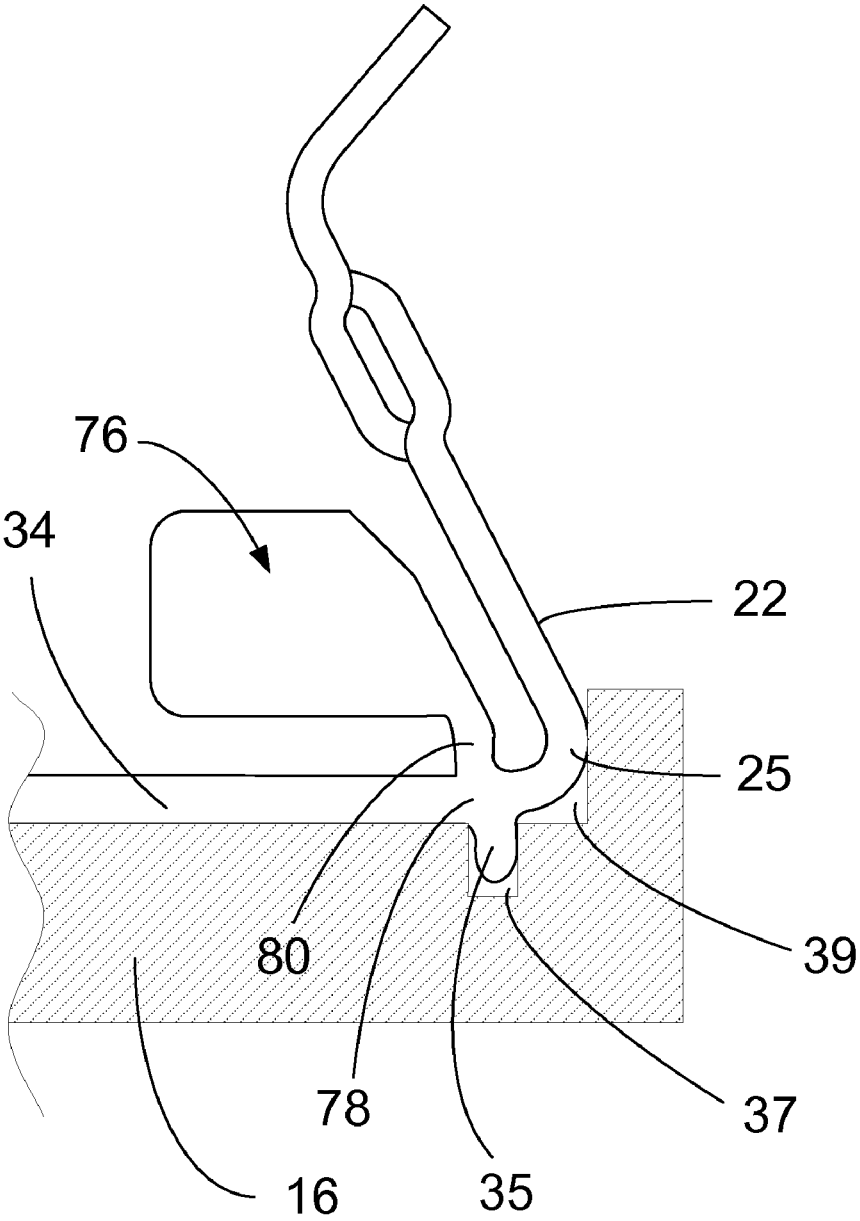
FIG. 17 is a diagrammatic illustration of a contact of the connector seated in the back part of the housing viewed through the line "Q"-"Q"

As particularly shown in FIG. 17, each one of the contacts 22, save contact 22*c*, includes a lug 35 extending into a corresponding recess 37 formed in the generally planar front side 30 of the back part 16 of the housing 12. The lugs 35 are located on fixed sections 34 of the contacts 22. In particular, the lugs 35 are located between the stems 78 and the elbows 25 of the contacts 22. The recess 37 is preferably common to all contacts 22 and extends across the generally planar front side 30 of the back part 16 of the housing 12.

Figure 15:
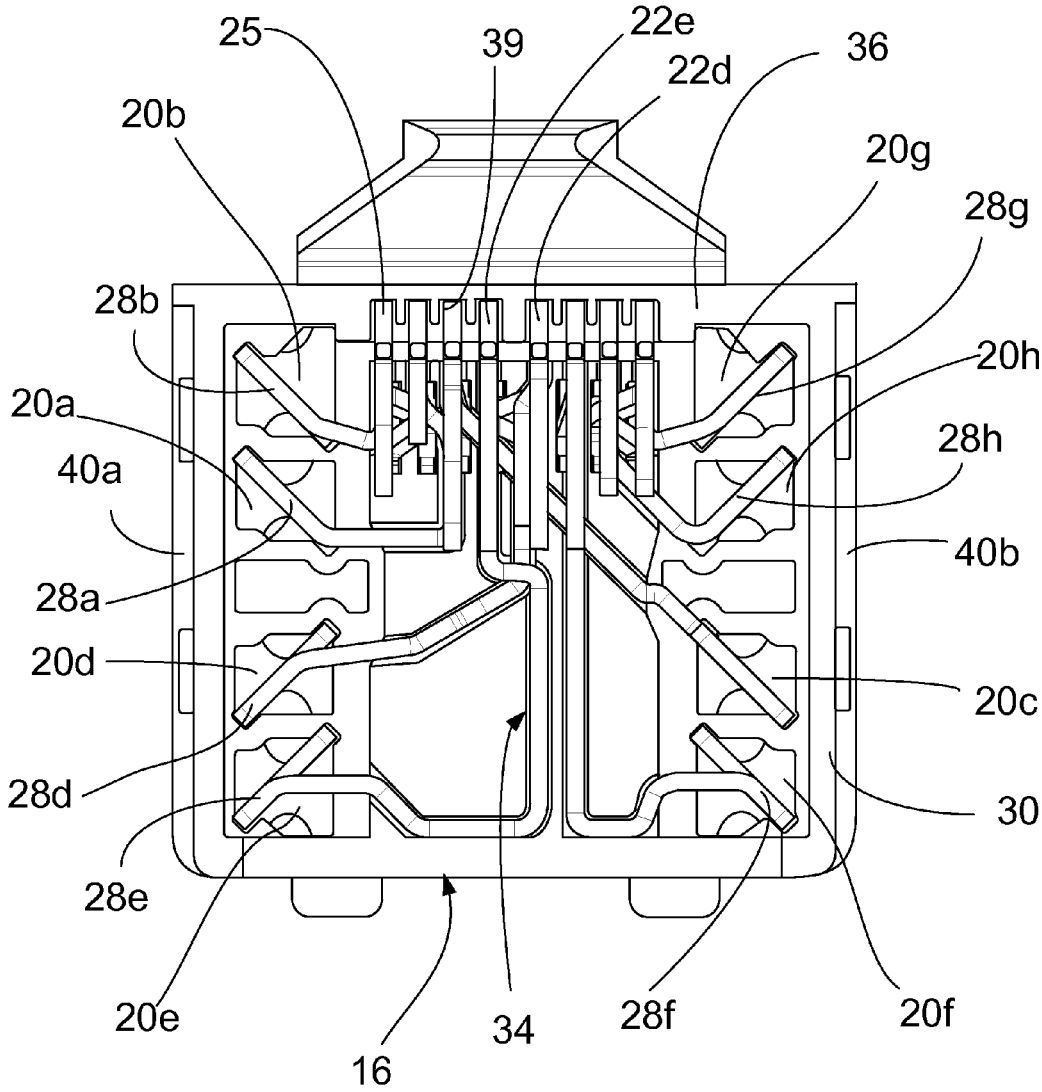
FIG. 15 is a diagrammatic illustration of a front view of the back part of the housing of the connector shown in FIG. 1 including contacts seated in channels in the back part of the housing.

As particularly shown in FIGS. 14 and 15, the front side 30 of the back part 16 of the housing 12 also includes a plurality of elbow seats 39 formed in the housing 12. Each elbow seat 39 is shaped to receive and seat therein an elbow 25 of the corresponding contact 22 in the manner shown in FIG. 15. The seats 39 separate the contacts 22 by predetermined amounts and inhibit movement of the contacts 22.

During assembly, the contacts 22 are seated in corresponding channels 32 in the manner shown in FIG. 15. When so arranged, the lugs 35 are seated in respective recesses 37 and the elbows 35 are located in corresponding seats 39. The distance between the lugs 35 and their corresponding elbows 25 is less than or equal to the distance between the recesses 37 and the corresponding seats 39. As such, opposite sides of the lugs 35 and corresponding elbows 25 bear against the housing 12 and act to hold the contacts 22 in fixed positions by frictional engagement therebetween. The action of the lugs 35 and elbows 25 bearing against the housing inhibits movement of the fixed sections34 of the contacts 22 and thereby inhibit relative movement of the capacitive plates 76. The operation of the plates is described in further detail below. The accurate location of the plates 76 allows the capacitance between the plates 76 to be accurately determined. The increased accuracy in the capacitance allows the connector 10 to be more accurately tuned in order to further reduce the effects of crosstalk on the signals carried therein.

Assembly of the Connector

During assembly of the connector 10, the contacts 22 are seated in their respective channels 32 so that the insulation displacement contacts 28 are seated in their insulation displacement contact slots 20. When so arranged, the elbows 25 of the contacts 22 are located in their seats 39 and are arranged in parallel along a common edge 36 of the housing 12. The spring finger contacts 24 extend outwardly away from the front side 30 of the back part 16 of the housing 12 at an angle of sixty degrees, for example, to the front side 30 in the manner shown in FIG. 12.

Figure 12:
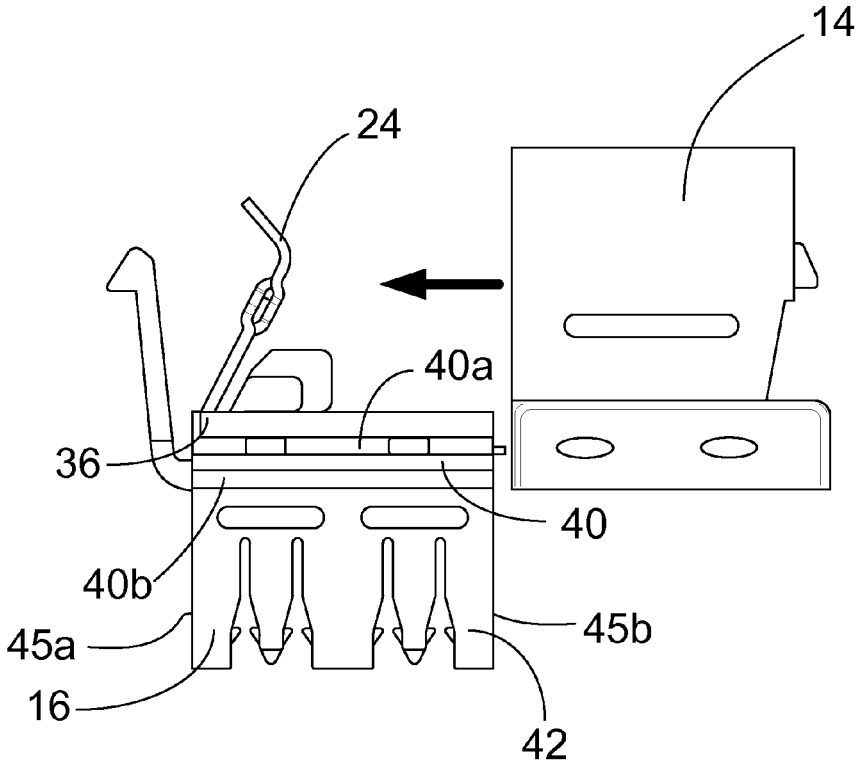
FIG. 12 is a diagrammatic illustration of a side view of the connector shown in FIG. 1 arranged in a first condition of use.
Figure 13:
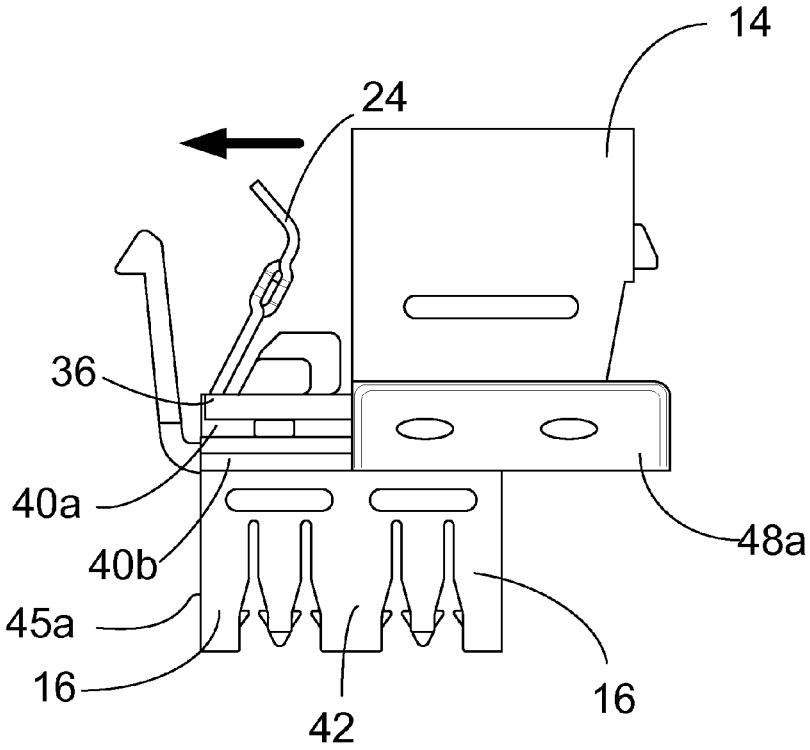
FIG. 13 is a diagrammatic illustration of a side view of the connector shown in FIG. 1 arranged in a second condition of use.

The front part 14 of the housing 12 is slidably couplable to the back part 16, in the manner shown in FIGS. 12 and 13, to encase the contacts 22 between respective opposed abutting surfaces 30, 30*b*. As particularly shown in FIG. 3, the back part 16 includes a groove 40 defined by spaced apart ribs 40*a*, 40*b* on the left hand side 42 of the housing 12 and a groove 44 defined by spaced apart ribs 44*a*, 44*b* on the right hand side 46 of the housing 12. The grooves 40, 44 run between the top 45*a* and bottom 45*b* sides of the housing 12. The front part 14 of the housing 12 includes left and right side flanges 48*a*, 48*b* that are shaped to pass over respective ones of the grooves 40, 44 when the front part 14 slides over the back part 16. Each flange includes an inwardly projecting lug 50*a*, 50*b* that slides along the grooves 40, 44 when the front part 14 and the back part 16 slide together. When seated in the grooves 40, 44, the lugs 50*a*, 50*b* secure the front part 14 to the back part 16. A bottom side flange 54 of the front part 14 of the housing 12 abuts the bottom side 45*b* of the back part 16 of the housing 12 when the front part 14 is slid into position in the above-described manner. The bottom side flange 54 limits travel of the front part 14 as it slides over the back part 16.

Figure 16:
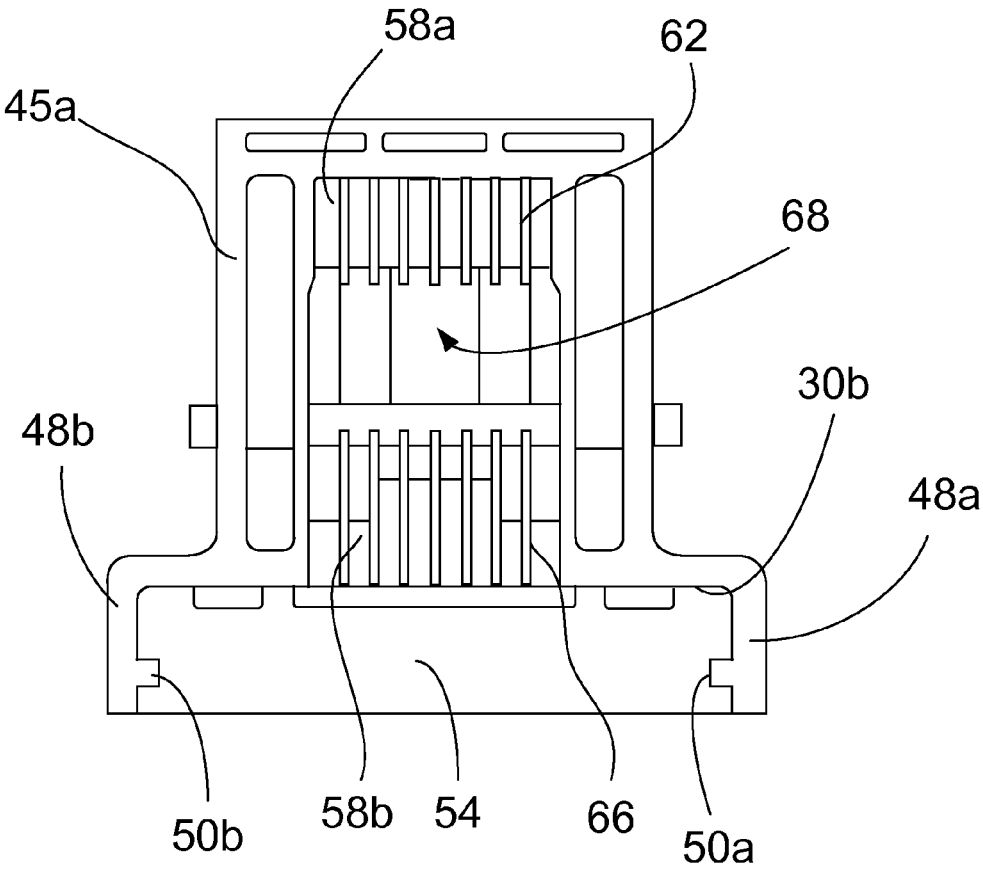
FIG. 16 is a diagrammatic illustration of a top view of the front part of the housing of the connector sown in FIG. 1.

As particularly shown in FIG. 16, the top side 45*a* of the front part 14 of the housing 12 includes eight parallel terminal channels 58*a*, each being shaped to receive a tip end section 60 of one of the spring finger contacts 24. The terminal channels 58*a* are defined by seven partitions 62 that extend in parallel outwardly from the front part 14 of the housing 12. The terminal channels 58*a* locate the tip ends 60 of the contacts 22 in fixed positions so that movement of the spring finger contacts 24 is restrained and the contacts 22 are electrically isolated from each other.

The top side 45*a* of the front part 14 of the housing 12 also includes eight parallel elbow channels 58*b*, each being shaped to receive a section 64 of the spring finger contacts 24 proximal the fixed sections 34. The elbow channels 58*b* are defined by seven partitions 66 that extend in parallel outwardly from the front part 14 of the housing 12. The elbow channels 58*b* locate the sections 64 of the contacts 22 in fixed positions so that movement of the spring finger contacts 24 is inhibited and the contacts 22 are electrically isolated from each other.

The top side 45*a* of the front part 14 of the housing 12 includes an aperture 68 lying between the terminal channels 58*a* and the elbow channels 58*b*. The aperture 68 extends through a top section 72 of the socket 18. Contact sections 70 of the contacts elements 22 extend through the aperture 68, between the terminal channels 58*a* and the elbow channels 58*b*, are accessible from the socket 18. A mating modular plug (not shown) can thereby be inserted into the socket 18 to effect electrical connection to the contact sections 70 of the contact elements 22.

The spring finger contacts 24 are seated in their respective channels 58*a*, 58*b* when the front part 14 of the housing slides over the back part 16 of the housing 12 in the manner shown in FIGS. 12 and 13. The contacts sections 70 are seated in the socket 18 when the front part 14 and the back part 16 are coupled together in the described manner. Having the front part 14 and the back part 16 of the housing 12 fit together in this manner simulates an over moulding process. The costly over moulding process is unnecessary if the connector 10 is manufactured in this manner.

The Compensation Scheme

The compensation scheme of the connector 10 seeks to compensate for any near end cross-talk and far end cross-talk coupling produced by the above-mentioned connector plug (not shown). The connector 10 is preferably designed such that the mated connection looks, electrically, as close as possible to the 100 Ohm cable characteristic impedance to ensure optimal return loss performance.

Terminal wiring assignments for modular plugs and jacks are specified in ANSI/EIA/TIA-568-1991 which is the Commercial Building Telecommunications Wiring Standard. This Standard associates individual wire-pairs with specific terminals for an 8-position telecommunications outlet (T568B) in the manner shown in FIG. 5. The following pairs are prescribed:

| | | |
|---|---|---|
| 1. | Pair 1 | Contacts 22d and 22e (Pins 4 and 5); |
| 2. | Pair 2 | Contacts 22a and 22b (Pins 1 and 2); |
| 3. | Pair 3 | Contacts 22c and 22f (Pins 3 and 6); and |
| 4. | Pair 4 | Contacts 22g and 22h (Pins 7 and 8). |

The above-mentioned pair assignment leads to some difficulties with cross-talk. This is particularly the case when high frequency signals are present on the wire pairs. For example, since Pair 3 straddles Pair 1, there will likely be electrical crosstalk between Pairs 1 and 3 because the respective electrical paths are parallel to each other and are in the same approximate plane. Although the amount of crosstalk between pairs 1 and 3 may be insignificant in the audio frequency band, for example, it is unacceptably high at frequencies above 1 MHz. Still, it is desirable to use modular plugs and jacks of this type at these higher frequencies because of connection convenience and cost.

The contacts 22 are arranged in the connector 10 to reduce the effects of cross-talk in communication signals being transmitted through the connector 10. The arrangement of the contacts 22 preferably renders the connector 10 suitable for high speed data transmission and is preferably compliant with the Category 6 communications standard. As above mentioned, electromagnetic coupling occurs between two pairs of contacts and not within a single pair. Coupling occurs when a signal, or electric field, is induced into another pair.

Figure 18:
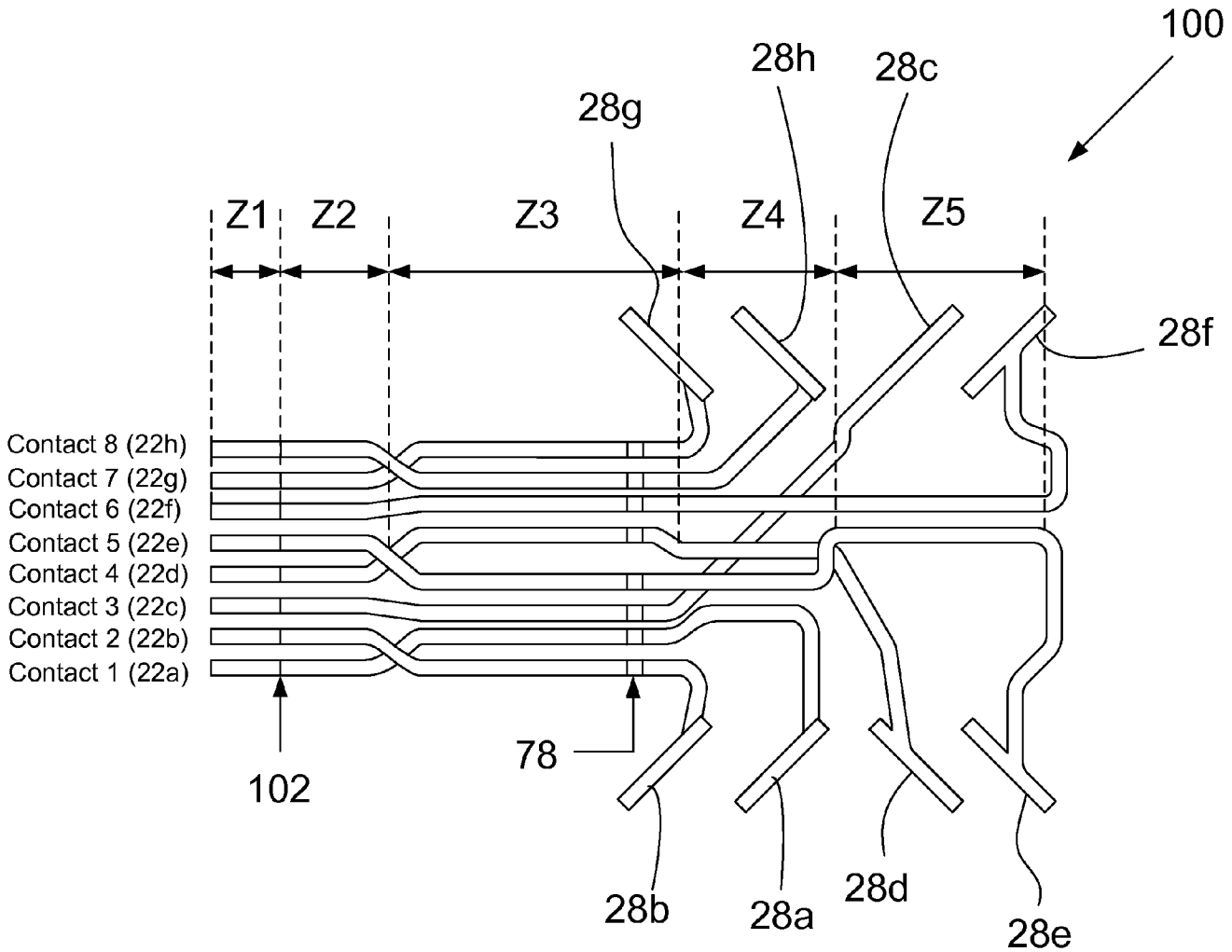
FIG. 18 is a diagrammatic illustration of a compensation zones of the contacts shown in FIG. 7.

The compensation scheme 100 of the connector 10 shown in FIG. 18 is divided into five zones (Z1 to Z5). Zones one to three include common features and are collectively described below. A detailed description of the compensation scheme 100 of the connector 10 with respect to the five zones is set out below.

1. Zone 1

As above described, parallel conductors 22 inside a connector jack 10 often contribute to crosstalk within the jack 10. Each conductor 22 acts like an antenna, transmitting signals to, and receiving signals from, the other conductors 22 in the connector 10. This encourages capacitive and inductive coupling, which in turn encourages crosstalk between the conductors 22. Capacitive coupling is dependent on the distance between components and the material between them. Inductive coupling is dependent on the distance between components.

The close proximity of the conductors 22 in zone one makes them vulnerable to capacitive coupling. Cross-talk is particularly strong at the point where signals are transmitted into cables. As the signals travel along cables they tend to attenuate, and thereby reduce electromagnetic interference caused by any given pulse.

Tip ends 60 of contacts 22 protruding beyond respective points of contact 102 of the RJ plug (not shown) and socket are considered to reside in zone 1 of the compensation scheme 100, as shown in FIG. 18. As above described, the tip ends 60 are seated in channels 58 defined by partitions 62. The tip ends 60 provide mechanical stability for the individual spring finger contacts 24. The partitions 62 are plastic fins that ensure correct spacing between the tip ends of the contacts 22. However, the tip ends 60 induce unwanted capacitive coupling between adjacent pairs of contacts. The plastic fins 62 increase unwanted capacitance as their dielectric is approximately three times greater than air.

Figure 19:
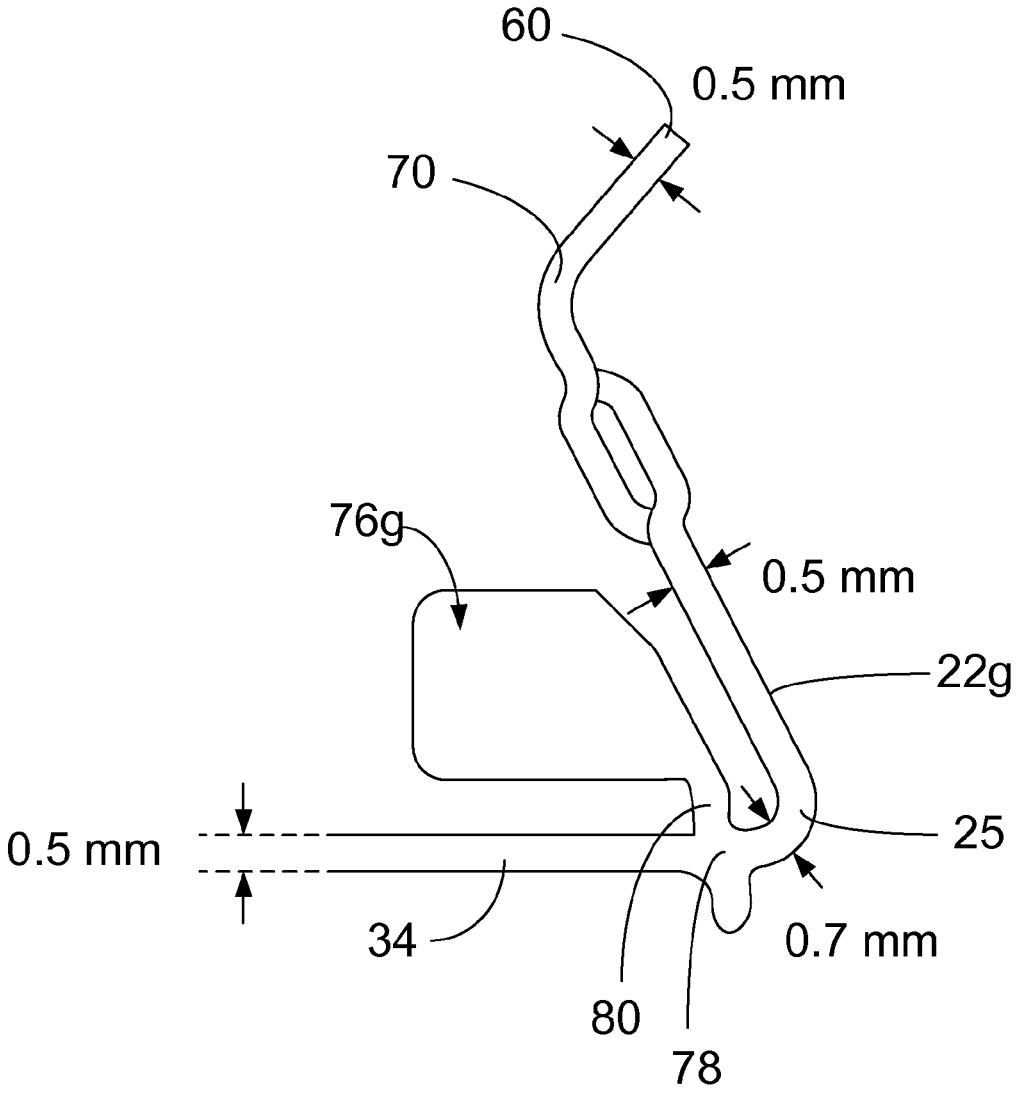
FIG. 19 is a diagrammatic illustration of a side view of the contact elements shown in FIG. 7.
Figure 28:
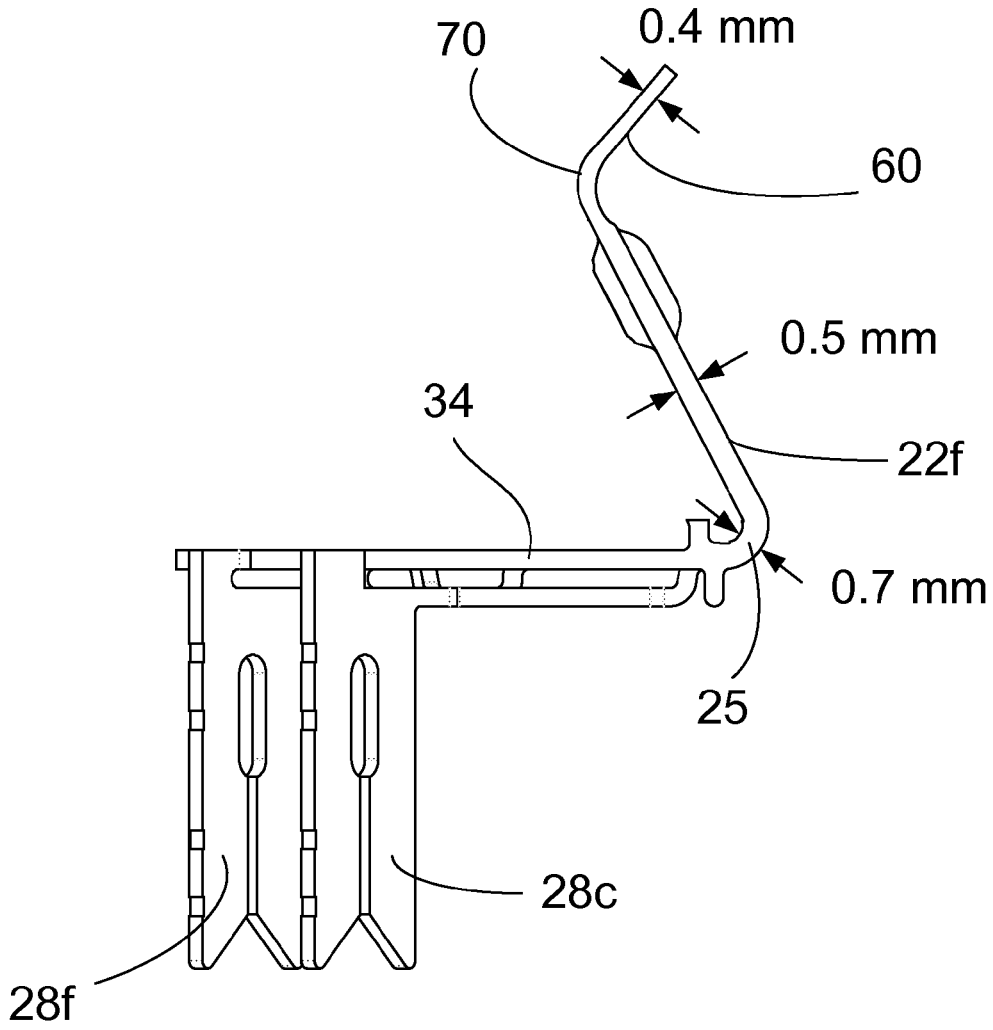
FIG. 28 is a diagrammatic illustration of a side view of the contacts shown in FIG. 27.

As particularly shown in FIGS. 19 and 28, the spring finger contacts 24 are coupled to fixed sections 34 of the contacts 22 by corresponding elbows 25. The depth of each contact 22 at its fixed section 34 is 0.5 mm. The depth increases at the elbows 25 to 0.7 mm. The elbows 25 act as pivots for the spring finger contacts 24 and have increased depth to strengthen the coupling of the spring finger contacts 24 to the fixed sections 34. Contact sections 70 and tip ends 60 of the contacts 22 have a depth of 0.5 mm.

Figure 20:
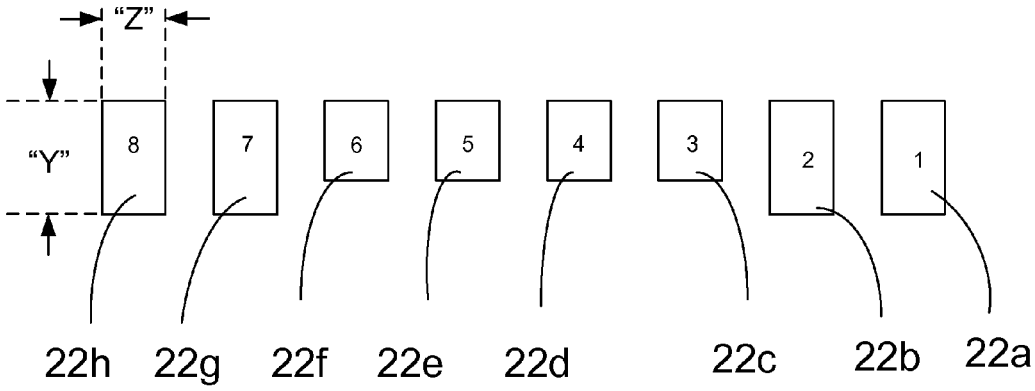
FIG. 20 is a diagrammatic illustration of a front view of tip end sections of the contact elements shown in FIG. 7.

As particularly shown in FIG. 20, tips ends 60 of the contacts 22*c*, 22*d*, 22*e* and 22*f* (Pins 3 to 6) have a reduced end profile. That is, tip ends 60 of contacts 22*c*, 22*d*, 22*e*, and 22*f* have a profile (Z by Y) reduced from 0.5 mm by 0.5 mm to 0.5 mm by 0.4 mm. By reducing the thickness by 0.1 mm, the capacitive component is reduced by twenty percent.

In an alternative arrangement, the width ("Z") of tip ends 60 of contacts 22*c*, 22*d*, and 22*e*, 22*f* is less than the width "Z" of the tip end 60 of contacts 22*a*, 22*b*, 22*g* and 22*h*. The width "Z" of the tip ends 60 of contacts 22*c*, 22*d*, and 22*e*, 22*f* is 0.4 mm and width of the tip ends 60 of contacts 22*a*, 22*b*, 22*g* and 22*h* is 0.5 mm, for example. As such, tip ends 60 of contacts 22*c*, 22*d*, 22*e*, 22*f* are separated by a distance "X" and tip ends of the contacts 22*a*, 22*b*, 22*h*, 22*g* are separated by a distance "Y", where "X">"Y". The reduced width of the contacts 22*c*, 22*d*, and 22*e*, 22*f* allows them to be spaced further apart with respect to traditional eight position, eight conductor (8P8C), connectors. This larger distance decreases the capacitive coupling between the contacts 10, thus reducing the effects of crosstalk introduced into any data signals carried therein.

2. Zone 2.

Electromagnetic coupling occurs between adjacent contacts 22 of the Pairs of contacts. The result is side to side crosstalk. To avoid the near-end crosstalk, the contact pairs may be arranged at very widely spaced locations from one another, or a shielding may be arranged between the contact pairs. However, if the contact pairs must be arranged very close to one another for design reasons, the above-described measures cannot be carried out, and the near-end crosstalk must be compensated.

The electric patch plug used most widely for symmetric data cables is the RJ-45 patch plug, which is known in various embodiments, depending on the technical requirement. Prior-art RJ-45 patch plugs of category 5 have, e.g., a side-to-side crosstalk attenuation of >40 dB at a transmission frequency 100 MHz between all four contact pairs. Based on the unfavorable contact configuration in RJ-45, increased side-to-side crosstalk occurs due to the design. This occurs especially in the case of the plug between the two pairs 3, 6 and 4, 5 because of the interlaced arrangement (e.g. EIA/TIA 568A and 568B). This increased side-to-side crosstalk limits the use at high transmission frequencies. However, the contact assignment cannot be changed for reasons of compatibility with the prior-art plugs.

Figure 21:
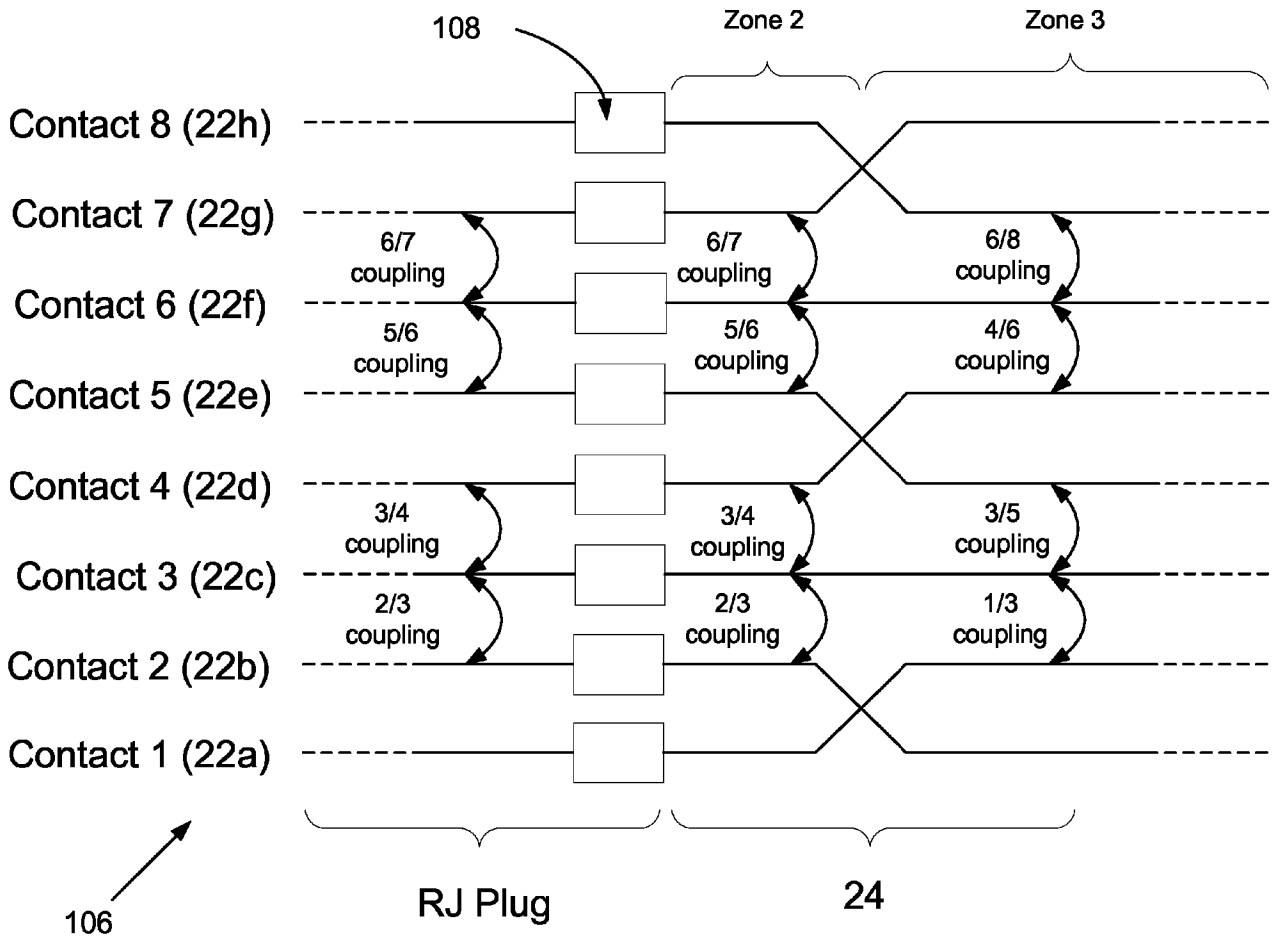
FIG. 21 is a schematic diagram showing a the contacts elements shown in FIG. 7 coupled to corresponding contacts of a connector plug.
Figure 22A:
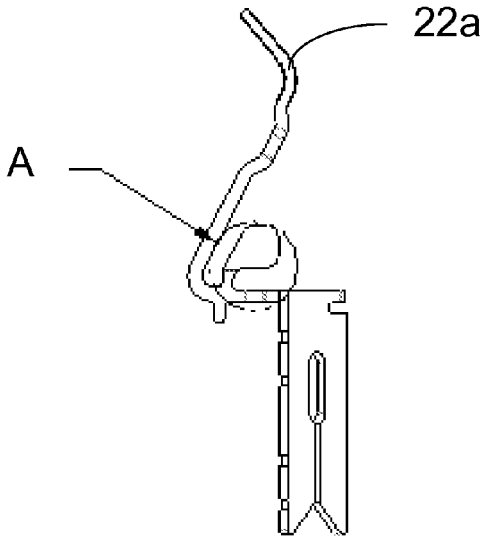
FIG. 22*a* is a diagrammatic illustration of a side view of a contact element of the contact elements shown in FIG. 7.
Figure 22B:
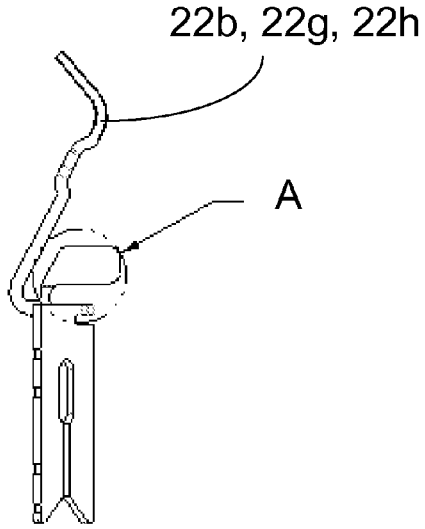
FIG. 22*b* is a diagrammatic illustration of a side view of another contact element of the contact elements shown in FIG. 7.
Figure 22C:
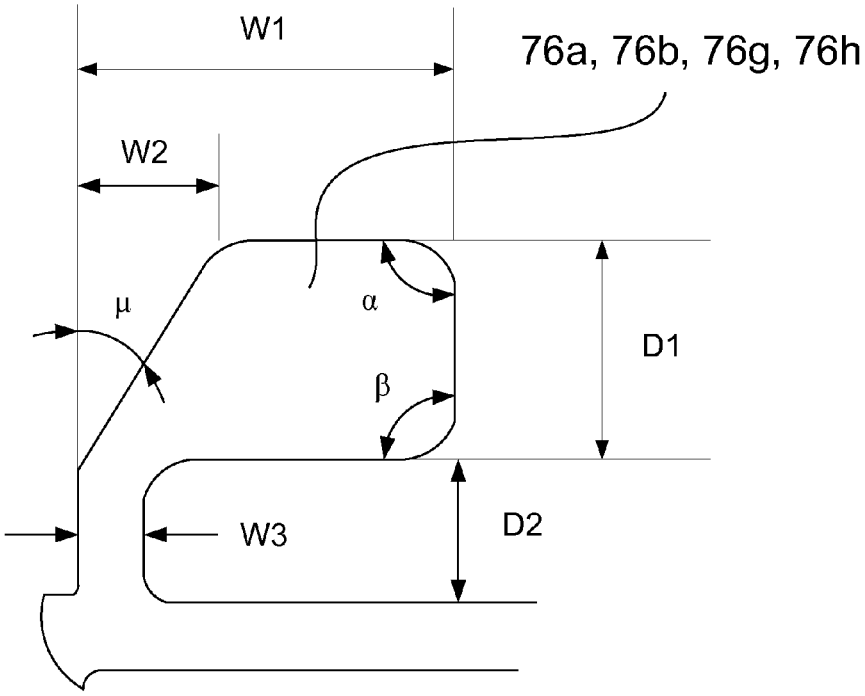
FIG. 22*c* is a diagrammatic illustration of a side view of a capacitor plate of the contact shown in FIGS. 22*a* and 22*b;*
Figure 23A:
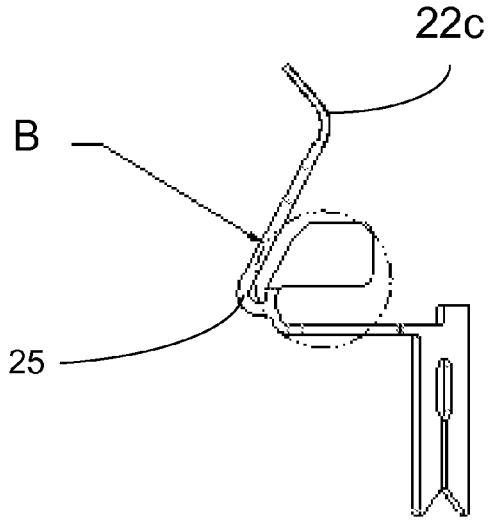
FIG. 23*a* is a diagrammatic illustration of a side view of yet another contact of the contacts shown in FIG. 7.
Figure 23B:
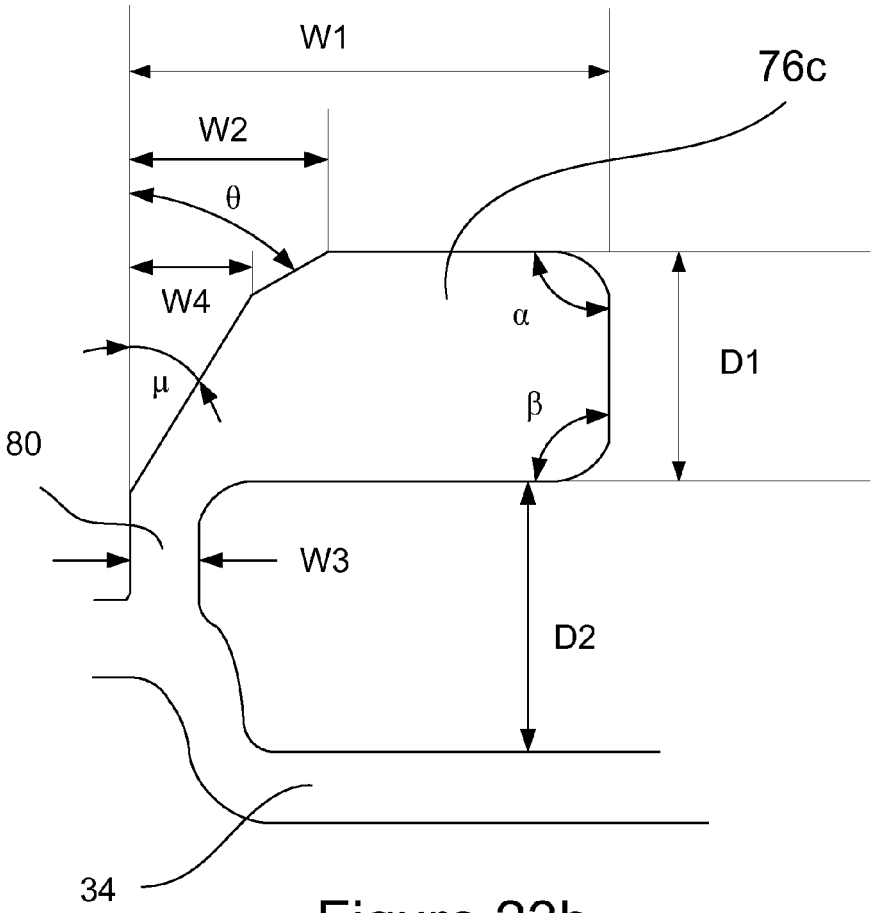
FIG. 23*b* is a diagrammatic illustration of a capacitor plate of the contact shown in FIG. 23*a;*
Figure 24A:
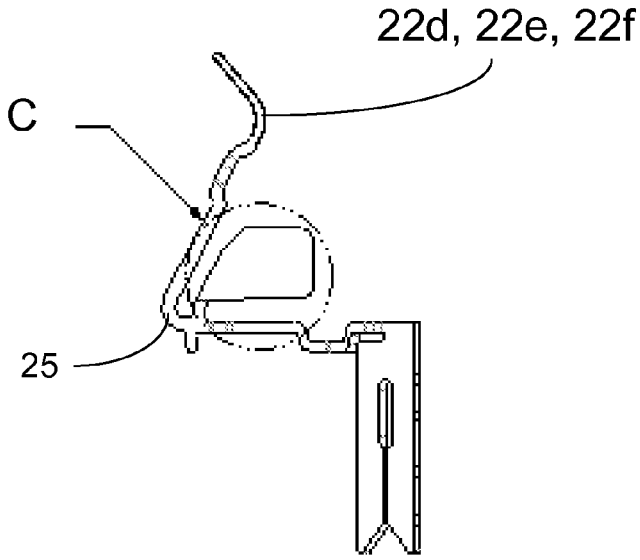
FIG. 24*a* is a diagrammatic illustration of a side view of still another contact of the contacts shown in FIG. 7.
Figure 24B:
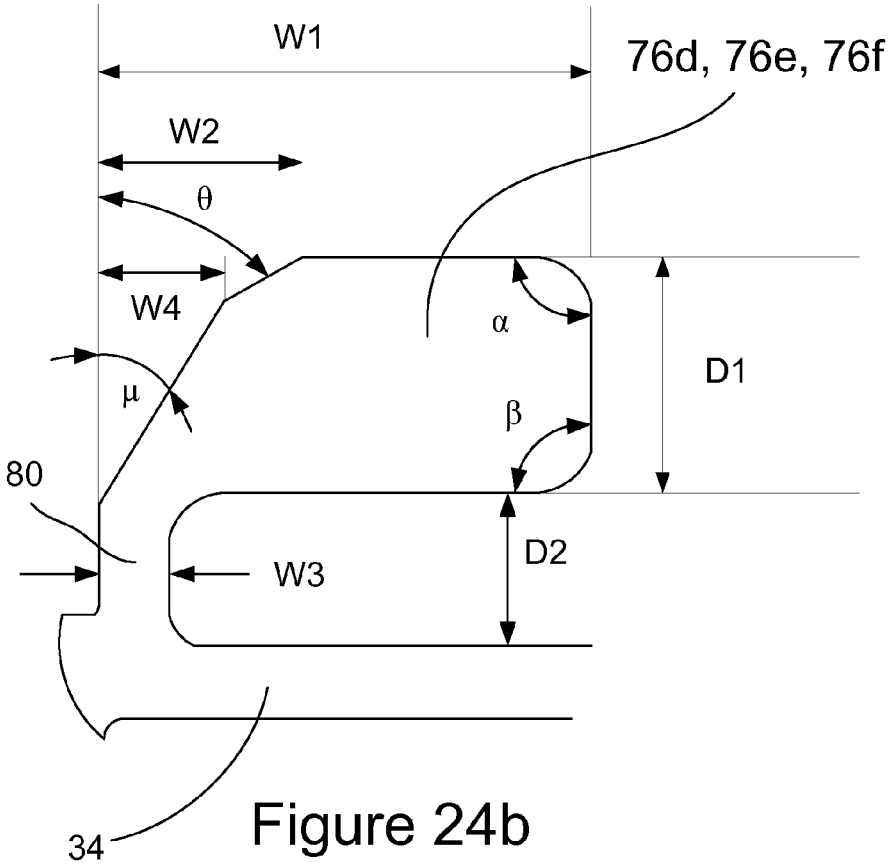
FIG. 24*b* is a diagrammatic illustration of a capacitor plate of the contact shown in FIG. 24*a;*

In the arrangement shown in FIG. 21, the following contacts are crossed over a. 22*d* and 22*e* of Pair 1;

b. 22*a* and 22*b* of Pair 2; and c. 22*g* and 22*h* of Pair 4.

The above-mentioned pairs of contacts 22 are crossed over at positions as close as possible to the point of contact 102 between the RJ plug 106 and the socket so as to introduce compensation to the RJ plug as soon as possible. The crossover of the mentioned contacts is effected to induce "opposite" coupling to the coupling seen in the RJ plug 106 and in the section of the spring finger contacts 24 immediately after the point of contact 102 between the plates 108 in the RJ plug 106 and socket of the connector 10. Coupling between contacts 22*e* and 22*f* and contacts 22*c* and 22*d* is introduced in the RJ plug 106 due to the geometry of the plug 106. The same coupling is seen in the socket due to the necessary mating geometry. The crossover of contacts 22*d* and 22*e* then allows coupling into opposite pair of contacts.

3. Zone 3.

Figure 11:
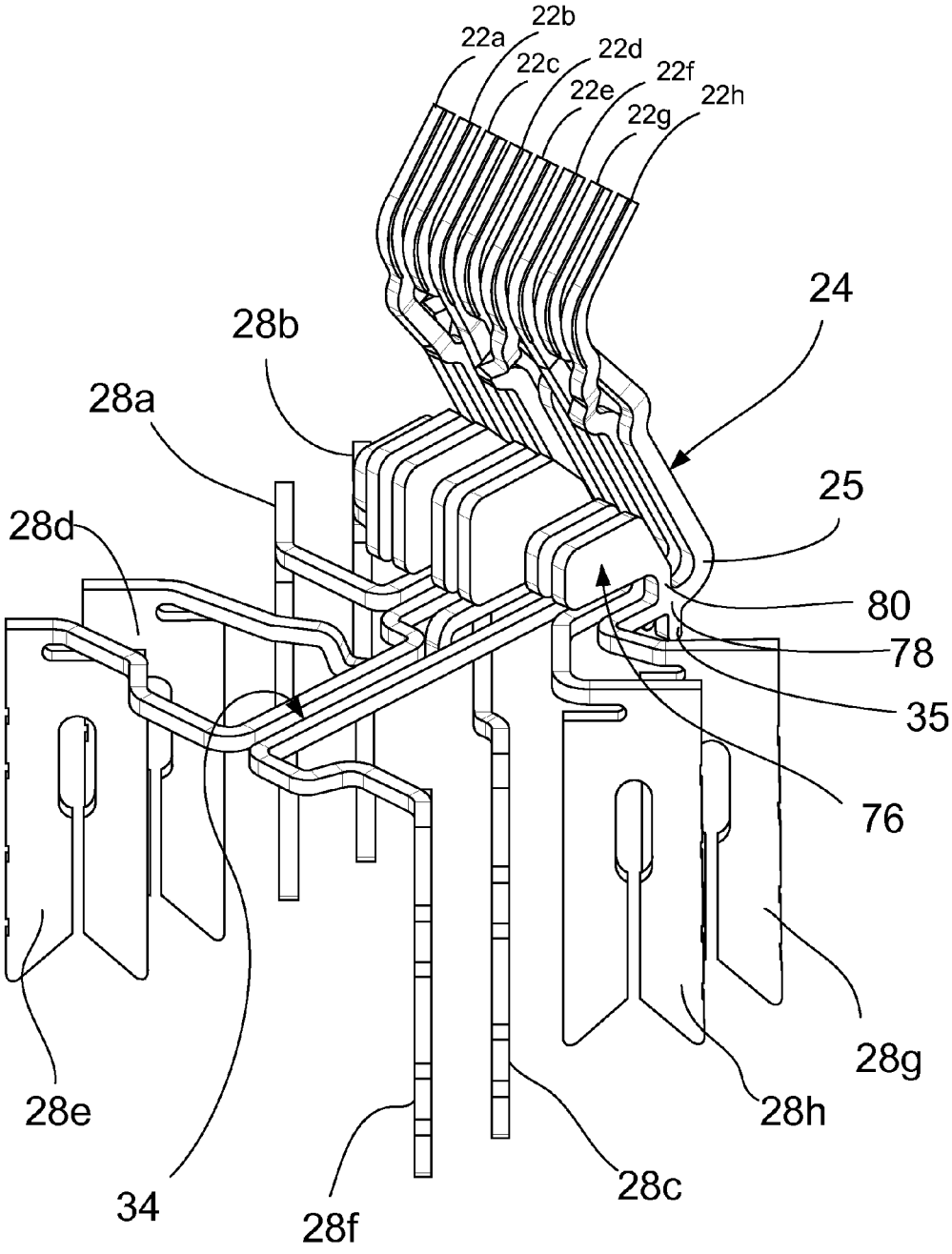
FIG. 11 is a diagrammatic illustration of another perspective view of the electrically conductive contact elements shown in FIG. 7.

As particularly shown in FIG. 11, the electrically conductive contacts 22 each include a capacitive plate 76. The plates 76 are electrically coupled to common points 78 of respective fixed sections 34 of the contacts 22. The capacitive plates 76 are used to improve the crosstalk characteristics of parallel contacts 22. The capacitive plates 76 compensate for the capacitance in the RJ plug 106 and the capacity components in the lead frame area of the connector 10. The jack 10 has a number of large, or relatively large, components that have capacitance. The plates 76 compensate for these capacitances.

The length of Zone 3 is dictated by the geometry of the connector 10, mechanical constraints and the need to mount the capacitor plates on a stable area. The following aspects of zone three are described below in further detail:

a. Position of the capacitive plates 76;

b. Stems of the capacitive plates 76;

c. Relative size of the capacitive plates 76; and d. Dielectric material.

a. Position

The capacitive plates 76 are created as integral parts of the contacts 22, for example, located at common points 78 on respective the fixed sections 34 close to the elbows 25. The closer that these plates 76 are to the contacts 108 of the mating modular plug 106, the greater the effect they have on crosstalk compensation. The common points 78 are located on the fixed sections to inhibit relative movement of the plates 76 during usage. Movement of the plates 76 reduces the effectiveness of these plates 76 to compensate for cross-talk.

The capacitive plates 76 are coupled to respective common points 78 of the contacts 22 so that crosstalk compensation is effected simultaneously across the contacts 22.

In designing the connector 10, as a first approximation, the connector 10 is made to look like the mating RJ plug 106. In the plug 106, there are relatively large capacitive plates 108 near the interface with the connector 10. The capacitive plates 76 advantageously mimic the capacitive plates 108 in the plug 106 by placing the plates 76 as close as possible to the connector/plug interface.

b. Stems

As particularly shown in FIG. 19, the plates 7 are coupled to respective common points 78 of the fixed sections 34 by electrically conductive stems 80 located at positions close to the elbows 25. The stems 80 are, for example, located as close to the elbows 25 as possible without being effected by movement at the elbows 25 caused by the spring finger contacts 24. The stems 80 are located to provide maximum compensation without loss due to relative movement of the capacitive plates 76.

The stems 80 are preferably 1 mm in length. This distance is preferably sufficient to inhibit capacitive coupling between the capacitive plates 76 and respective fixed sections 34 of the contacts 22.

c. Relative Size

As particularly shown in FIGS. 22*a* to 24*b*, the capacitive plates 76 are generally rectangular electrically conductive plates connected at one end to respective fixed sections 34 of the contacts 22 by the stems 78. The plates 76 extend, in parallel, away from corresponding elbows 25 in the manner shown in FIG. 11. Capacitive coupling is induced between overlapping sections of neighbouring plates 76. The relative size of the overlapping sections of neighbouring plates 76, in part, determines the relative capacitance between such plates. As such, the relative size of the overlapping sections of the plates 76 is used to tune capacitance compensation. The relative size of the capacitive plates 76 of the contacts 22 is set out in Table 1 with reference to FIGS. 22*a* to 24*b*.

TABLE 1

Dimensions of the Capacitive Plates (mm)

| | Plate | | | | | | | |
|---|---|---|---|---|---|---|---|---|
| | 76a | 76b | 76c | 76d | 76e | 76f | 76g | 76h |
| D1 | 1.95 +/− 0.10 | 1.95 +/− 0.10 | 3.36 +/− 0.10 | 3.36 +/− 0.10 | 3.36 +/− 0.10 | 3.36 +/− 0.10 | 1.95 +/− 0.10 | 1.95 +/− 0.10 |
| D2 | 0.95 | 0.95 | ? | 0.95 | ? | ? | 0.95 | 0.95 |
| W1 | 2.6 +/− 0.1 | 4.1 +/− 0.1 | 5.7 +/− 0.1 | 5.7 +/− 0.1 | 5.7 +/− 0.1 | 5.7 +/− 0.1 | 4.1 +/− 0.1 | 4.1 +/− 0.1 |
| W2 | 1.13 +/− 0.10 | 1.13 +/− 0.10 | 2.45 +/− 0.10 | 2.45 +/− 0.10 | 2.45 +/− 0.10 | 2.45 +/− 0.10 | 1.13 +/− 0.10 | 1.13 +/− 0.10 |

TABLE 1-continued

| Dimensions of the Capacitive Plates (mm) | | | | | | | | |
|---|---|---|---|---|---|---|---|---|
| | Plate | | | | | | | |
| | 76a | 76b | 76c | 76d | 76e | 76f | 76g | 76h |
| W3 | 0.5 +/− 0.1 | 0.5 +/− 0.1 | 0.5 +/− 0.1 | 0.5 +/− 0.1 | 0.5 +/− 0.1 | 0.5 +/− 0.1 | 0.5 +/− 0.1 | 0.5 +/− 0.1 |
| W4 | n/a | n/a | 1.34 +/− 0.10 | 1.34 +/− 0.10 | 1.34 +/− 0.10 | 1.34 +/− 0.10 | | |
| β | $91.0^0$ | $91.0^0$ | $91.0^0$ | $91.0^0$ | $91.0^0$ | $91.0^0$ | $91.0^0$ | $91.0^0$ |
| α | $91.0^0$ | $91.0^0$ | $91.0^0$ | $91.0^0$ | $91.0^0$ | $91.0^0$ | $91.0^0$ | $91.0^0$ |
| μ | $28.0^0$ +/− $0.5^0$ | $28.0^0$ +/− $0.5^0$ | $28.0^0$ +/− $0.5^0$ | $28.0^0$ +/− $0.5^0$ | $28.0^0$ +/− $0.5^0$ | $28.0^0$ +/− $0.5^0$ | $28.0^0$ +/− $0.5^0$ | $28.0^0$ +/− $0.5^0$ |
| θ | n/a | n/a | $45.0^0$ +/− $0.5^0$ | $45.0^0$ +/− $0.5^0$ | $45.0^0$ +/− $0.5^0$ | $45.0^0$ +/− $0.5^0$ | n/a | n/a |

This ability to change the capacitance between any two adjacent plates 76 allows the manufacturer to change the capacitive coupling between any two conductive paths 22 within the connector 10. This high level of control over the capacitances in turn allows more control over the compensation of crosstalk generated between any parallel contacts within the connector.

As above mentioned, the overlapping area of two adjacent plates 76 determines the area over which capacitance may occur. In the general case, this is determined by the area of the smaller plate. The relative area between adjacent pairs of capacitive plates 76 is set out in Table 2. With control over the plate areas, the relative capacitance between any two adjacent plates may be uniquely determined and changed simply by changing the relevant plate sizes.

TABLE 2

| Effective dielectric areas | | | | | |
|---|---|---|---|---|---|
| | Effective Area of each dielectric component | | | | Combined Dielectric Values Based |
| Plate Pair | Housing Area ($mm^2$) | % of Total | Air Area ($mm^2$) | % of Total | on Individual Areas |
| 76b-76a | 3.93 | 100.00% | 0 | 0.00% | 3.000 |
| 76a-76c | 1.94 | 49.36% | 1.98 | 50.38% | 1.985 |
| 76c-76e | 4.64 | 29.26% | 11.22 | 70.74% | 1.585 |
| 76e-76d | 15.86 | 100.00% | 0 | 0.00% | 3.000 |
| 76d-76f | 4.64 | 29.26% | 11.22 | 70.74% | 1.585 |
| 76f-76h | 5.78 | 84.83% | 1.034 | 15.17% | 2.697 |
| 76h-76g | 6.81 | 100% | 0 | 0.00% | 3.000 |

d. Dielectric Material.

In designing the connector 10, as a first approximation, the connector 10 is made to look like the mating RJ plug 106. In the plug 106, there are relatively large capacitive plates near the interface with the connector 10. The capacitive plates 76 advantageously mimic the capacitive plates in the plug 106. The plates 76 are located as close as possible to the connector/plug interface. There is also excessive capacitive coupling in the fixed section 34 and insulation displacement contacts 28 of the contacts 22. The capacitive plates 76 also compensate for this additional capacitive coupling.

Figure 25:
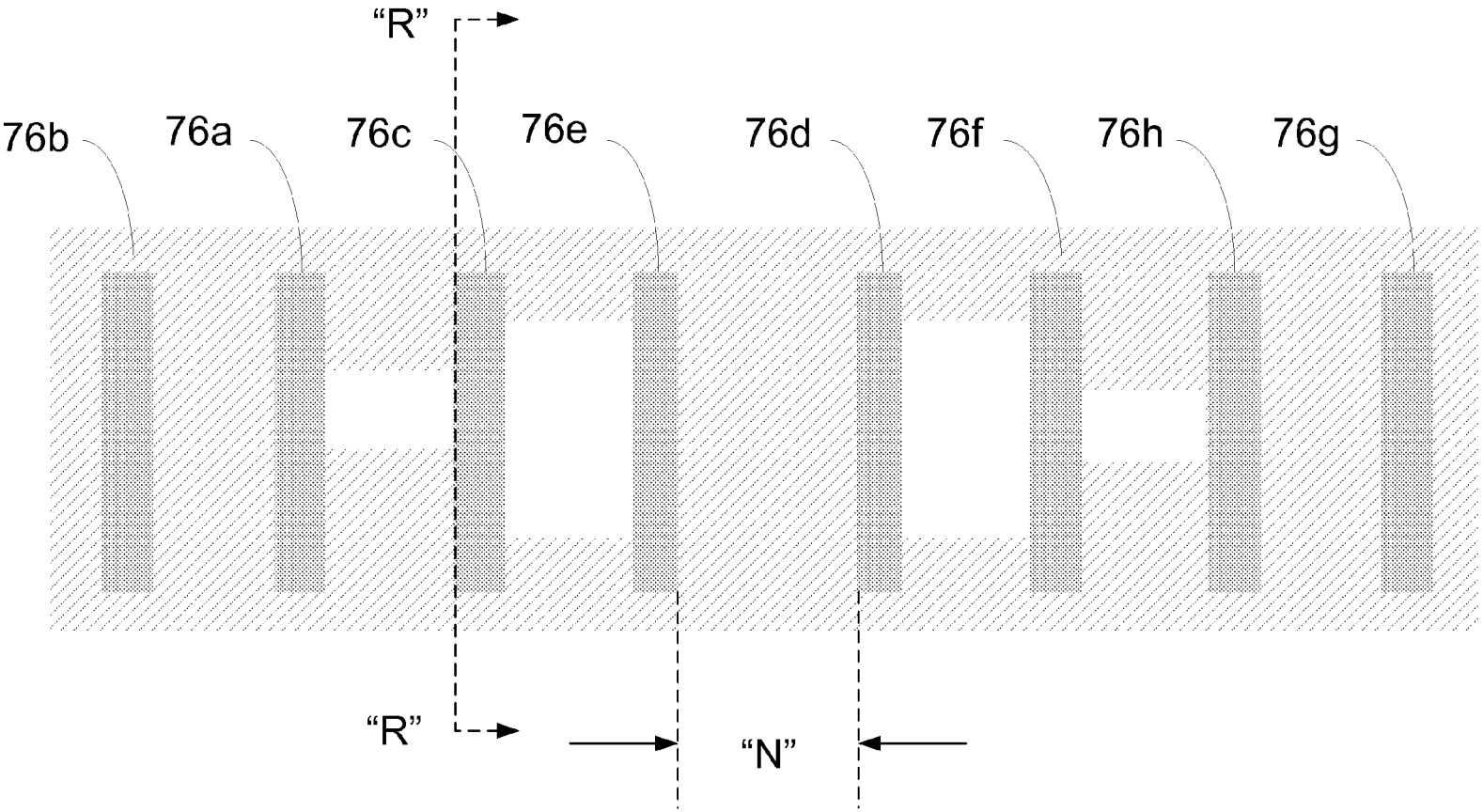
FIG. 25 is a diagrammatic illustration of a front view of the connector through the line "S"-"S"
Figure 26:
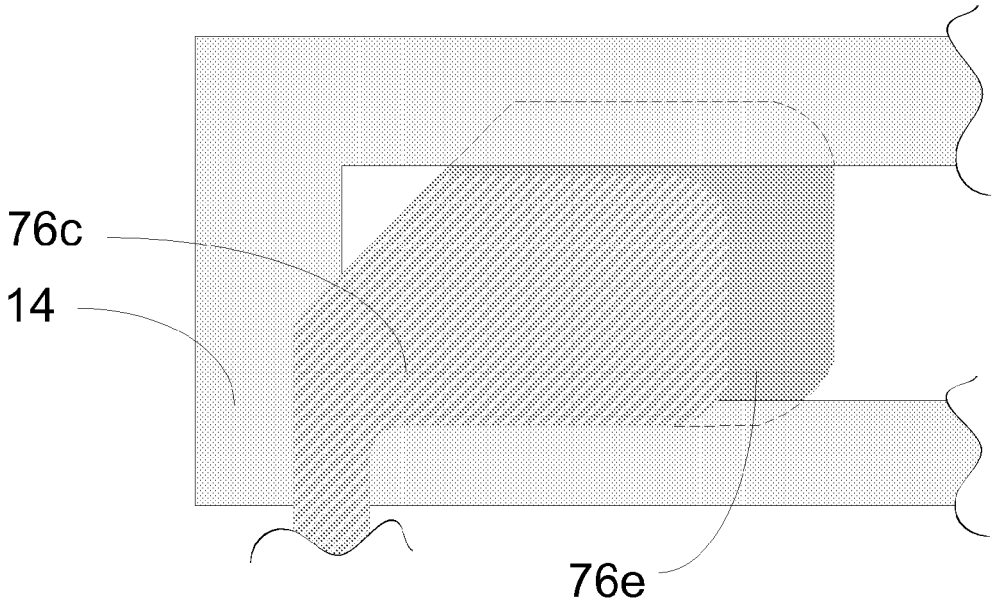
FIG. 26 is a diagrammatic illustration of a side view of the connector through the line "R"-"R"

As particularly, shown in FIGS. 25 and 26, the plates 76 are positioned, and in some cases separated by, the housing 12 which is made of a polymeric material with a dielectric constant three times larger than that of a vacuum, for example. The housing 12 thereby inhibits relative movement of the plates 76. The space between any two adjacent plates 76 is occupied by:

i. The connector housing 12;

ii. Air; or iii. A combination of the connector housing 12 and air.

The proportion of housing 12 and air which fills the volume between any two adjacent plates 76 dictates the dielectric constant of the space between the same two plates. This, in turn, dictates the capacitance between these two plates. As the relative area of the housing 12 between any two plates is increased, the corresponding dielectric constant between the plates 76 is increased. These effective dielectric areas are shown in Table 2.

The capacitance between any two adjacent plates 76 is also determined by the distance between them when measured normal to the plate area (normal distance shown as "N" in FIG. 25). The larger the normal distance "N" between the plates, the less capacitance between them. The exact normal distances between each pair of adjacent plates as set out in Table 3. These distances, when combined with the fractional areas in Table 2, result in the capacitances given in Table 4.

TABLE 3

| Normal distances between Plates P1-P8 | |
|---|---|
| Plate Pair | Normal Distance Between Plates (mm) |
| 76b-76a (P2-P1) | 0.516 |
| 76a-76c (P1-P3) | 0.516 |
| 76c-76e (P3-P5) | 0.516 |
| 76e-76d (P5-P4) | 1.016 |
| 76d-76f (P4-P6) | 0.516 |
| 76f-76h (P6-P8) | 0.516 |
| 76h-76g (P8-P7) | 0.516 |

TABLE 4

| Resultant capacitance between plate pairs | | |
|---|---|---|
| Plate Pairs | Combined Dielectric Values Based on Individual Areas | Resulting Capacitance (pF) |
| 76b-76a (P2-P1) | 3.000 | 22.85 |
| 76a-76c (P1-P3) | 1.985 | 15.12 |
| 76c-76e (P3-P5) | 1.585 | 48.72 |
| 76e-76d (P5-P4) | 3.000 | 46.83 |
| 76d-76f (P4-P6) | 1.585 | 48.72 |
| 76f-76h (P6-P8) | 2.697 | 35.61 |
| 76h-76g (P8-P7) | 2.998 | 39.59 |

Spacing between the contacts 22*d* & 22*e* has been doubled relative to the spacing between the other pairs. This gap improves the return loss performance of the Pair 1 (22*d* & 22*e*) and provides for additional tuning in Zone 4.

4. Zone 4.

The contacts 22 in zone 4 are arranged to improve near end crosstalk performance. In particular, the contacts 22 are arranged to offset and balance some of the coupling introduced in zone 3. A detailed description of the arrangement of the contacts in zone 4 is out below.

Figure 27:
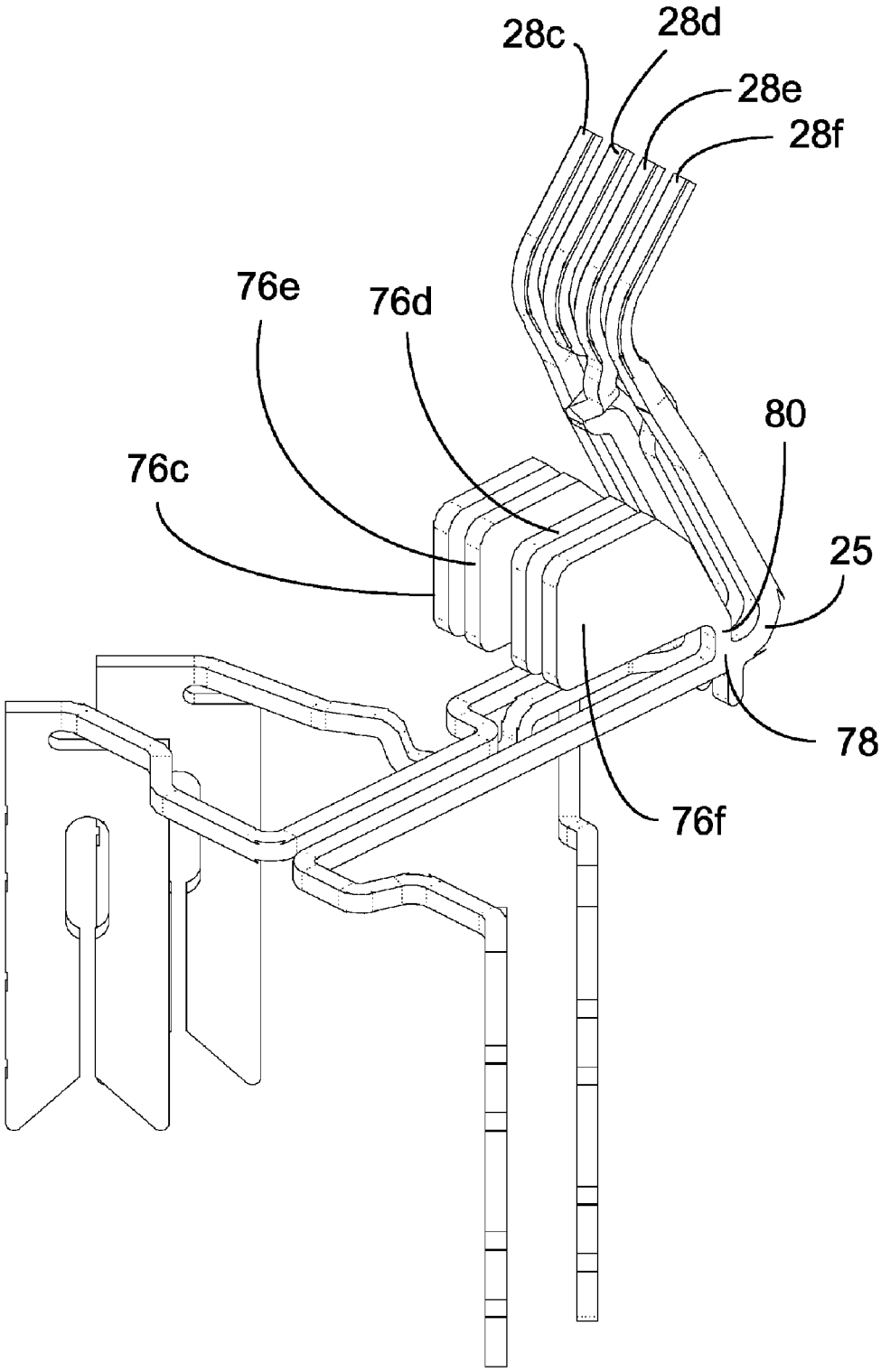
FIG. 27 is a diagrammatic illustration of a perspective view of two pairs of contacts of the contacts shown in FIG. 7.
Figure 29:
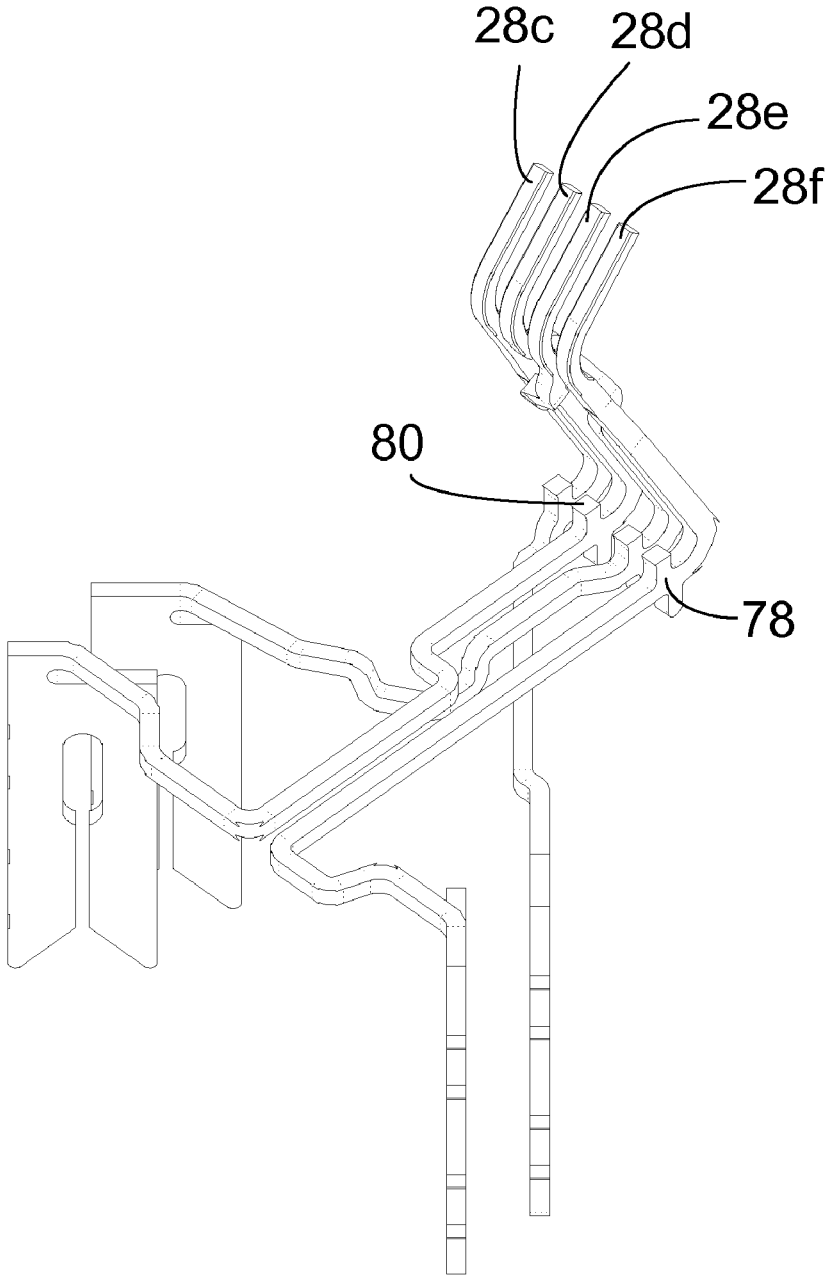
FIG. 29 is a diagrammatic illustration of another perspective view of the contacts shown in FIG. 27.

The arrangement of the contacts 22*c*, 22*d*, 22*e* and 22*f* of pairs 4, 5 and 3, 6 is shown in FIGS. 27 to 29. Spacing between contacts 22*d* and 22*e* (Pins 4 and 5) is reduced to 0.5 mm. This is effected by stepping the path of contact 22*d* (Pin 4) closer to the path of contact 22*e* (Pin 5). In doing so, contact 22*d* (Pin 4) is stepped away from contact 22*f* (Pin 6). This reduces coupling between the contacts 22*d* and 22*f* (Pins 4 & 6). This stepping process is facilitated by the above described initial separation of contacts 22*d* and 22*e* (Pins 4 & 5), as shown in FIG. 15.

Contacts 22*d* and 22*e* (Pins 4 & 5) are crossed over at the end of zone 4 to induce a phase shift in the signal and to allow introduction of "opposite" coupling. For example, coupling between contacts 22*e* and 22*f* (Pins 5 & 6).

Contact 22*c* (Pin 3) is moved away from contact 22*e* (Pin 5) as soon as possible. This has the effect of removing any additional coupling that would be induced by the proximity of surrounding contacts 22. As particularly shown in FIGS. 14 and 15, the channel 32*c* for contact 22*c* (Pin 3) is 1.5 mm deep and extends transversely through channels 32*e*, 32*d*, and 32*f* towards the insulation displacement contact slot 20*c*. The contact 22*c* (Pin 3) is seated in the channel 32*c* such that is passes under contacts 22*e*, 22*d* and 22*f* when seated in respective channels 32*e*, 32*d*, and 32*f*. The influence of contact 22*c* (Pin 3) on the other contacts 22 has been minimised in zone 4 by running the contact 22*c* under all other contacts.

The length of zone 3 is determined by point of crossing over of contacts 22*e* and 22*d* (Pins 4 & 5) and the position at which contact 22*d* (Pin 4) deviates away from contact 22*f* (Pin 6).

Figure 30:
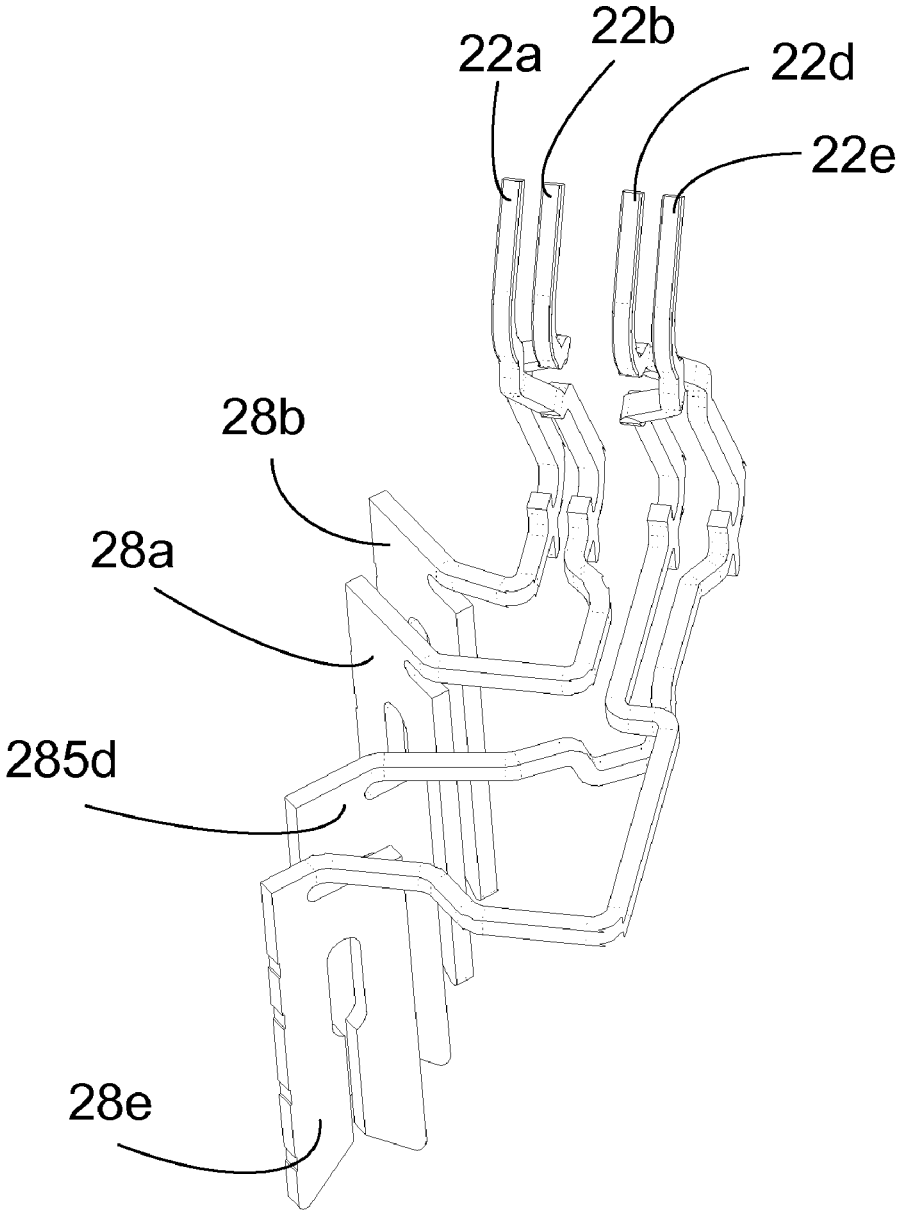
FIG. 30 is a diagrammatic illustration of a perspective view of another two pairs of contacts of the contacts shown in FIG. 7.

The arrangement of the contacts 22*a*, 22*b*, 22*d*, and 22*e* of pairs 4, 5 and 1, 2 is shown in FIG. 30. The spacing between contacts 22*d* and 22*e* (Pins 4 and 5) is reduced to 0.5 mm. This is effected by stepping the path of contact 22*d* (Pin 4) closer to the path of contact 22*e* (Pin 5). This stepping process is facilitated by the above described initial separation of contacts 22*d* and 22*e* (Pins 4 & 5), as shown in FIG. 15.

The spacing between contacts 22*a* (Pin 1) and 22*e* (Pin 5) is reduced to 0.5 mm. This is effected by stepping the contact 22*a* (Pin 1) towards contact 22*e* (Pin 5). Coupling is thereby increased between contacts 22*a* (Pin 1) and 22*e* (Pin 5).

As particularly shown in FIGS. 14 and 15, the channel 32*a* extends towards the insulation displacement contact slot 20*a* at the end of zone 4. Accordingly, the contact 22*a* (Pin 1) extends towards the insulation displacement contact slot 20*a* at the end of zone 4 when seated in the channel 32*a*.

Contact 22*b* (Pin 2) is moved away from contact 22*a* (Pin 1) as soon as possible. This has the effect of removing any additional coupling that would be induced by the proximity of surrounding contacts 22. As particularly shown in FIGS. 14 and 15, the channel 32*b* for contact 22*b* (Pin 1) is 0.5 mm deep and extends towards the insulation displacement contact slot 20*b* at the beginning of zone 4.

Similarly, contacts 22*g* and 22*h* (Pins 7 & 8) are moved away from contact 22*f* (Pin 6) as soon as possible. This has the effect of removing any additional coupling that would be induced by the proximity of surrounding contacts 22. As particularly shown in FIGS. 14 and 15, the channels 32*g* and 32*h* for contacts 22*g* and 22*h* (Pins 7 & 8) is 0.5 mm deep and extend towards respective the insulation displacement contact slots 20*g* and 20*h* at the beginning of zone 4.

5. Zone 5

The contacts 22 in zone 5 are arranged to improve near end crosstalk performance and to further offset and balance some of the coupling introduced in zone 3. As above mentioned, contacts 22*d* and 22*e* (Pins 4 & 5) are crossed over at the end of zone 4 to induce a phase shift in the signal and to allow introduction of "opposite" coupling. This is effected by stepping the path of contact 22*e* (Pin 5) closer to the path of contact 22*f* (Pin 6). As such, the spacing between contacts 22*e* and 22*f* (Pins 5 & 6) is reduced to 0.5 mm. Coupling is thereby induced between contacts 22*e* and 22*f* (Pins 5 & 6).

Contact 22*d* (Pin 4) is moved away from contact 22*e* (Pin 5) as soon as possible after the cross over towards the insulation displacement contact slot 20*d*. This has the effect of removing any additional coupling that would be induced by the proximity of surrounding contacts 22. As particularly shown in FIG. 15, the channel 32*d* for contact 22*d* (Pin 4) is generally 0.5 mm deep. However, the channel 32*d* is 1.5 mm deep at and around the cross over point. The contact 22*d* (Pin 4) is seated in the channel 32*d* such that is passes under contact 22*e* when the contacts 22*d* and 22*e* are seated in their respective channels 32*d* and 32*e*.

The length of zone 5 is determined by the distance which contacts 22*e* and 22*f* (Pins 5 & 6) are parallel. The contacts 22*e* and 22*f* each extend in opposite directions towards their respective insulation displacement contact slots 20*e* and 20*f* at the end of zone 5.

With reference to FIG. 18, the compensation can be thought of in terms of the following equation:

$$(5/6+3/4)_{RJPlug}+(5/6+3/4)_{RJSocket}=(4/6+3/5+5/6)_{RJSocket} \quad (1)$$

Orientation of IDCs

Figure 31:
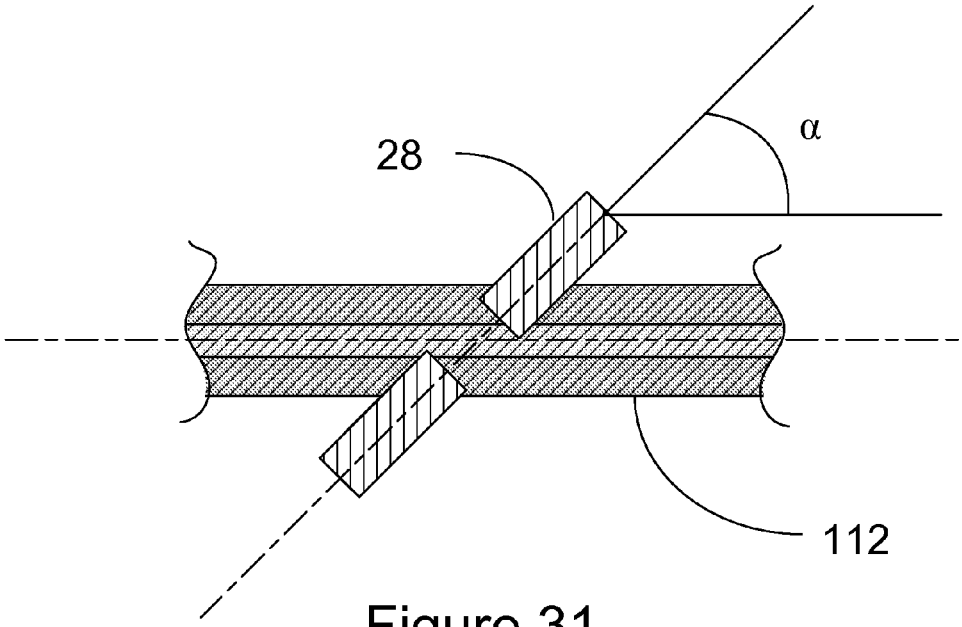
FIG. 31 is a diagrammatic illustration of a back view of an insulated conductor mated with an insulation displacement contact.
Figure 32:
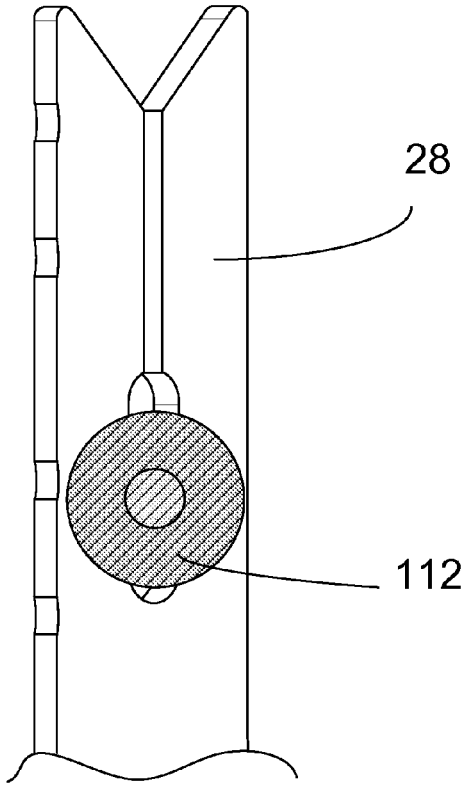
FIG. 32 is a diagrammatic illustration of a side view of an insulated conductor mated with an insulation displacement contact.

The insulation displacement contacts are arranged an angle "α" angle of 45 degrees to the direction of extent of mating insulated conductors 112, as shown in FIGS. 31 and 32. As above-described, during assembly, the contacts 22 are seated in the corresponding channels 32 of the back part 16 of the housing 12. The front part 14 of the housing 12 is then fitted over the back part 16 in the manner shown in FIGS. 12 and 13. In doing so, the insulation displacement contacts 28 are seated in their respective insulation displacement contact slots 20 in the manner shown in FIG. 15. The insulation displacement contact slots 20 are shaped to receive the corresponding insulation displacement contacts 28 and retain them in fixed positions for mating with insulated conductors.

Figure 8:
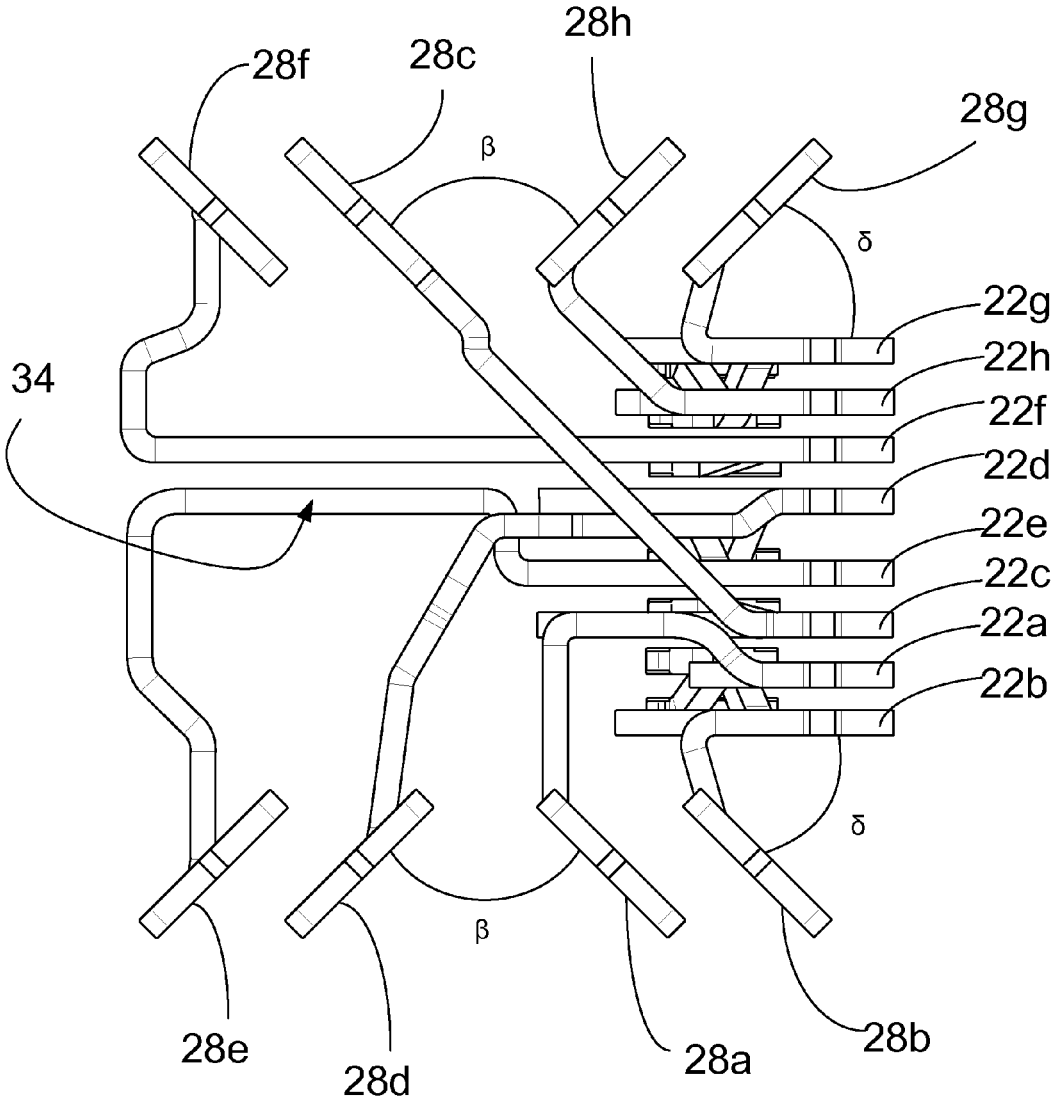
FIG. 8 is a diagrammatic illustration of a back view of the electrically conductive contact elements shown in FIG. 7.
Figure 9:
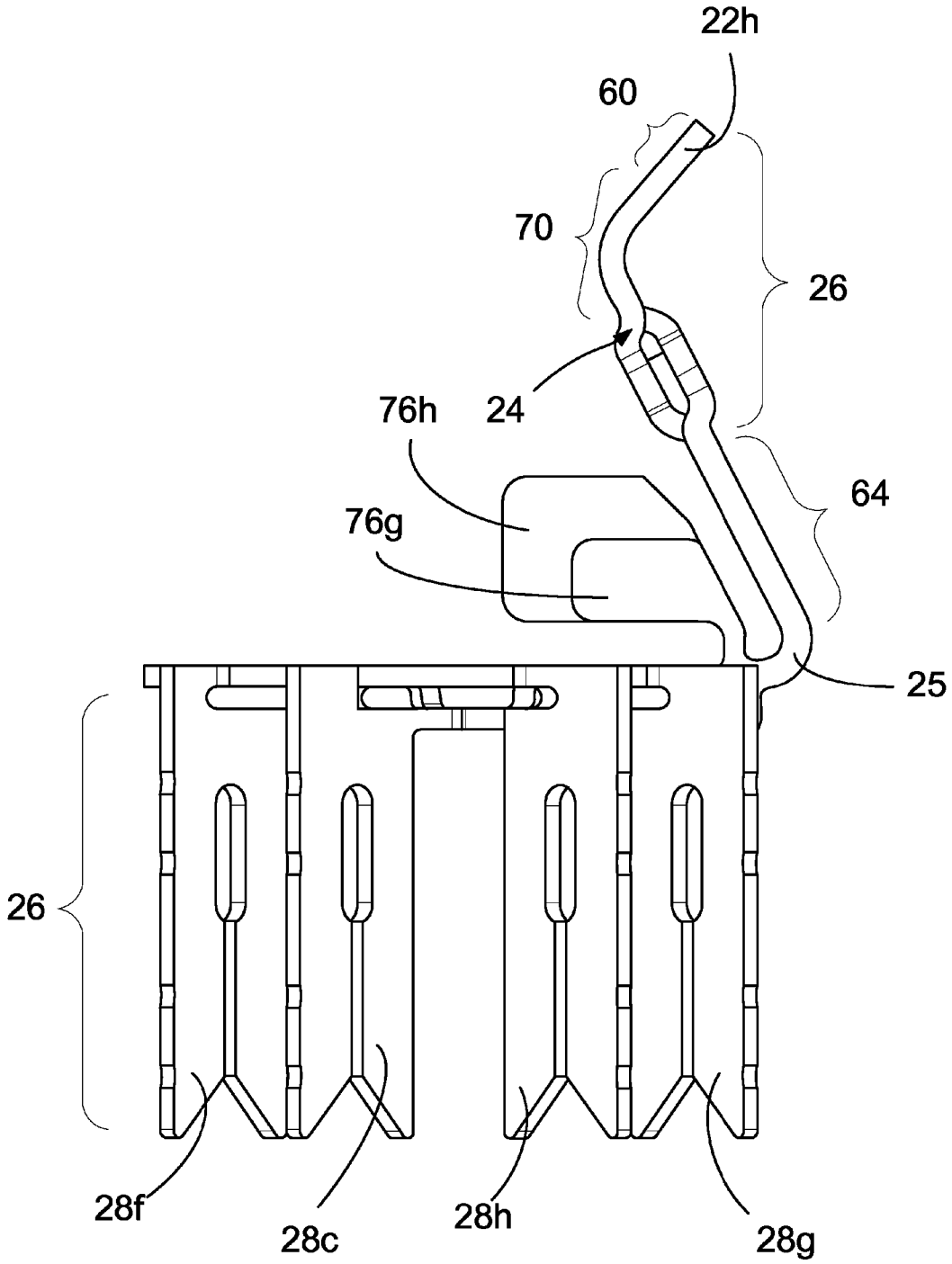
FIG. 9 is a diagrammatic illustration of a side view of the electrically conductive contact elements shown in FIG. 7.
Figure 10:
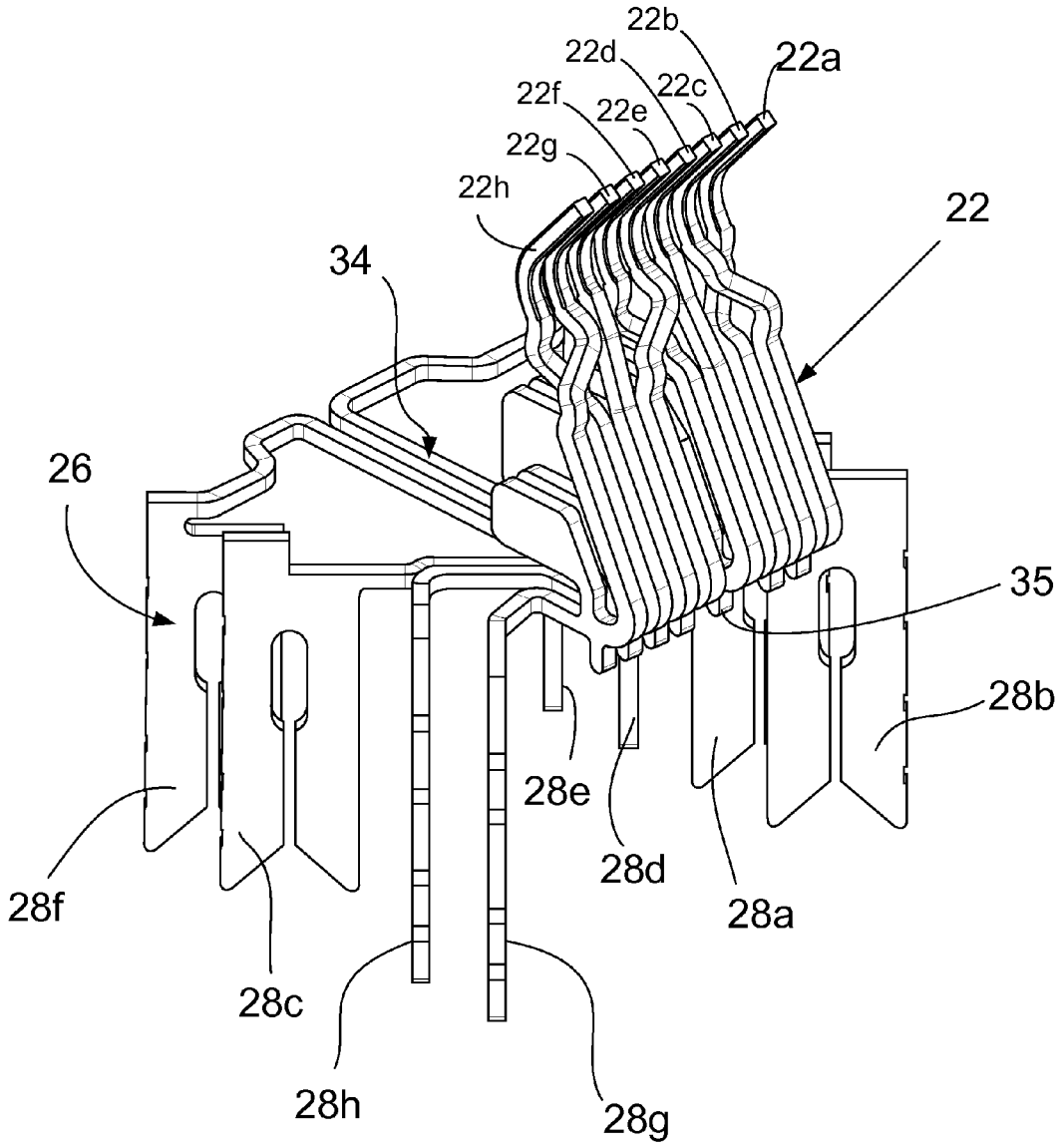
FIG. 10 is a diagrammatic illustration of a perspective view of the electrically conductive contact elements shown in FIG. 7.

The insulation displacement contacts 28 are arranged in pairs in accordance with the T568 wiring standard. Capacitive coupling between pairs of insulation displacement contacts 28 can create a problem, inducing crosstalk between the signals travelling thereon. In order to discourage capacitive coupling, adjacent contacts 28 of neighbouring pairs open in different directions. The pairs of contacts 28 preferably open at an angle "β" of ninety degrees with respect to each other, as shown in FIG. 8. The gap is maximised between the pairs of contacts 28 to minimise the effects of coupling.

The insulation displacement contacts 28 are each arranged at an angle "δ" of forty five degrees with respect to the direction of the capacitive plates 76, for example.

While we have shown and described specific embodiments of the present invention, further modifications and improvements will occur to those skilled in the art. We desire it to be understood, therefore, that this invention is not limited to the particular forms shown and we intend in the append claims to cover all modifications that do not depart from the spirit and scope of this invention.

Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge in Australia.

Claims defining the invention:

1. An electrical connector for transmitting data signals between the insulated conductors of a first data cable and corresponding insulated conductors of a second data cable, comprising:

(a) a socket shaped to at least partially receive a plug of said first data cable;

(b) a plurality of insulation displacement contact slots shaped to receive end sections of the conductors of the second data cable; and (c) a plurality of electrically conductive contacts including resiliently compressible spring finger contacts extending into the socket for electrical connection with corresponding conductors of the first cable; and insulation displacement contacts seated in corresponding insulation displacement contact slots for effecting electrical connection with corresponding conductors of the second data cable, wherein the insulation displacement contact slots are arranged so that adjacent pairs of insulation displacement contacts open in different directions.

2. The connector claimed in claim 1, wherein the insulation displacement contact slots are arranged so that pairs of insulation displacement contacts open in common directions.

3. The connector claimed in claim 1, wherein the insulation displacement contact slots are arranged so that the corresponding insulation displacement contacts engage end sections of the conductors of the second data cable at an angle of forty five degrees to the direction of extent of said end sections.

4. The electrical connector claimed in claim 1, wherein the insulation displacement contacts of contacts one and two (as described by the T568A wiring standard) open in a common direction substantially ninety degrees to a common direction in which the insulation displacement contacts of contacts four and five (as described by the T568A wiring standard) open.

5. The electrical connector claimed in claim 1, wherein the insulation displacement contacts of contacts three and six (as described by the T568A wiring standard) open in a common direction substantially ninety degrees to a common direction in which the insulation displacement contacts of contacts seven and eight (as described by the T568A wiring standard) open.

6. The electrical connector claimed in claim 1, wherein the arrangement of the insulation displacement contacts reduces the effects of crosstalk in the connector.

* * * * *